US012736246B2

(12) United States Patent
Mou et al.

(10) Patent No.: US 12,736,246 B2
(45) Date of Patent: Sep. 15, 2026

(54) AIR POLLUTION PREVENTION SYSTEM FOR BATHROOM SPACE

(71) Applicant: Microjet Technology Co., Ltd., Hsinchu (TW)

(72) Inventors: Hao-Jan Mou, Hsinchu (TW); Chin-Chuan Wu, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 301 days.

(21) Appl. No.: 18/733,198

(22) Filed: Jun. 4, 2024

(65) Prior Publication Data

US 2025/0060121 A1 Feb. 20, 2025

(30) Foreign Application Priority Data

Aug. 15, 2023 (TW) ..... 112130633

(51) Int. Cl.
*F24F 8/108* (2021.01)
*F24F 8/10* (2021.01)
(Continued)

(52) U.S. Cl.
CPC ..... *F24F 11/63* (2018.01); *F24F 8/10* (2021.01); *F24F 8/22* (2021.01); *F24F 11/70* (2018.01);
(Continued)

(58) Field of Classification Search
CPC ..... F24F 11/63; F24F 8/10; F24F 8/22; F24F 11/70; F24F 2110/10; F24F 2110/20;
(Continued)

(56) References Cited

U.S. PATENT DOCUMENTS

2022/0404056 A1* 12/2022 Bloemer ..... F24F 11/58
2023/0233976 A1 7/2023 Mou et al.
(Continued)

FOREIGN PATENT DOCUMENTS

CN 208108410 U 11/2018
CN 110958891 A 4/2020
(Continued)

OTHER PUBLICATIONS

Extended European Search Report for European Application No. 24188564.9, dated Oct. 23, 2024.

*Primary Examiner* — Frank M Lawrence, Jr.
(74) *Attorney, Agent, or Firm* — Birch, Stewart, Kolasch & Birch, LLP

(57) ABSTRACT

An air pollution prevention system for bathroom space includes plural gas detectors, at least one filtration device, at least one exhaust fan and a cloud computing server. Plural gas detectors are disposed indoor and outdoor for detecting air pollution and outputting air pollution information. The cloud computing server receives and stores air pollution information to form a database of air pollution data. When a value of air pollution information exceeds a safety detection value, the cloud computing server issues a control command for enabling the exhaust fan to guide and exhaust the air pollution to the outdoor field, and simultaneously issues another control command for enabling a fan of the filtration device to guide the air pollution in the bathroom space to pass through a filter element of the filtration device, thereby controlling a gas state of the bathroom space at a level of air pollution close to zero.

20 Claims, 25 Drawing Sheets

(51) Int. Cl.

| | |
|---|---|
| ***F24F 8/22*** | (2021.01) |
| ***F24F 8/80*** | (2021.01) |
| ***F24F 11/63*** | (2018.01) |
| ***F24F 11/70*** | (2018.01) |
| ***F24F 11/74*** | (2018.01) |
| *F24F 110/10* | (2018.01) |
| *F24F 110/20* | (2018.01) |
| *F24F 110/64* | (2018.01) |
| *F24F 110/66* | (2018.01) |
| *F24F 110/70* | (2018.01) |

(52) U.S. Cl.
CPC ..... *F24F 2110/10* (2018.01); *F24F 2110/20* (2018.01); *F24F 2110/64* (2018.01); *F24F 2110/66* (2018.01); *F24F 2110/70* (2018.01)

(58) Field of Classification Search
CPC ..... F24F 2110/64; F24F 2110/66; F24F 2110/70; F24F 8/80; F24F 11/74; F24F 11/64; F24F 8/108; F24F 2110/50; F24F 2110/65; F24F 2110/72; F24F 2110/74; F24F 8/192; F24F 8/30; F24F 8/90; F24F 11/39; F24F 11/54; F24F 11/58; F24F 13/20; F24F 13/28; B01D 37/00; B01D 37/04; B01D 37/041; B01D 37/045; B01D 37/048; B01D 50/00
USPC ..... 95/8–10, 12, 14, 1; 96/109–117, 223, 96/224, 226; 55/385.2; 422/24, 186, 422/186.3
See application file for complete search history.

(56) References Cited

U.S. PATENT DOCUMENTS

| | | | | |
|---|---|---|---|---|
| 2023/0235914 | A1 | 7/2023 | Mou et al. | |
| 2024/0344725 | A1* | 10/2024 | Mou | F24F 8/10 |
| 2024/0401834 | A1* | 12/2024 | Ranajee | G05B 15/02 |
| 2025/0129963 | A1* | 4/2025 | Mou | F24F 3/167 |
| 2025/0155132 | A1* | 5/2025 | Mou | F24C 15/2021 |

FOREIGN PATENT DOCUMENTS

| | | | |
|---|---|---|---|
| CN | 116510456 | A | 8/2023 |
| JP | 6-185770 | A | 7/1994 |
| JP | 5388982 | B2 | 1/2014 |
| JP | 2022-98449 | A | 7/2022 |
| JP | 2022-171551 | A | 11/2022 |
| JP | 2022-176062 | A | 11/2022 |
| JP | 2023-107714 | A | 8/2023 |
| TW | 201250180 | A1 | 12/2012 |
| TW | M550806 | U | 10/2017 |
| TW | 202038488 | A | 10/2020 |
| TW | 202242325 | A | 11/2022 |
| TW | I796113 | B | 3/2023 |
| TW | 202331161 | A | 8/2023 |

* cited by examiner

AIR POLLUTION PREVENTION SYSTEM FOR BATHROOM SPACE

CROSS-REFERENCE TO RELATED APPLICATION

This application claims priority to Taiwan Patent Application No. 112130633, filed on Aug. 15, 2023. The entire contents of the above-mentioned patent application are incorporated herein by reference for all purposes.

FIELD OF THE INVENTION

The present disclosure relates to an air pollution prevention system for bathroom space, and more particularly to an air pollution prevention system for bathroom space in an indoor field.

BACKGROUND OF THE INVENTION

Suspended particles are solid particles or droplets contained in the air. Due to their extremely fine size, the suspended particles may enter the lungs of human body through the nasal hairs in the nasal cavity easily, causing inflammation in the lungs, asthma or cardiovascular disease. If other pollutant compounds are attached to the suspended particles, it will further increase the harm to the respiratory system. In recent years, the problem of air pollution is getting worse. In particular, the concentration of particle matters (e.g., PM2.5) is often too high. Therefore, the monitoring to the concentration of the gas suspended particles is taken more and more seriously. However, the gas flows unstably due to variable wind direction and air volume, and the general gas-quality monitoring station is located in a fixed place. Under this circumstance, it is impossible for people to check the concentration of suspended particles in current environment.

Furthermore, in recent years, modern people are placing increasing importance on the quality of the air in their surroundings. For example, carbon monoxide, carbon dioxide, volatile organic compounds (VOC), PM2.5, nitric oxide, sulfur monoxide and even the suspended particles contained in the air are exposed in the environment to affect the human health, and even endanger the life seriously. Therefore, the quality of environmental air has attracted the attention of various countries. At present, how to detect the air quality and avoid the harm is a crucial issue that urgently needs to be solved.

In order to confirm the quality of the air, it is feasible to use a gas sensor to detect the air in the surrounding environment. If the detection information can be provided in real time to warn people in the environment, it is helpful of avoiding the harm and facilitates people to escape the hazard immediately, thereby preventing the hazardous gas exposed in the environment from affecting the human health and causing the harm. Therefore, it is considered a valuable application to use a gas sensor to detect the air in the surrounding environment. Accordingly, how to intelligently and rapidly detect indoor air pollution sources and maintain suitable temperature and humidity in the bathroom space for forming a clean and safely breathable gas state is a main subject developed in the present disclosure.

SUMMARY OF THE INVENTION

The major object of the present disclosure is to provide an air pollution prevention system for bathroom space. By disposing a plurality of gas detectors in outdoor and indoor fields, the gas detectors can determine air pollution and output air pollution information. Then, a cloud computing server receives the air pollution information, stores the air pollution information to form a database of air pollution data. When a value of the air pollution information of the bathroom space exceeds a safety detection value, the cloud computing server issues a control command to enable an exhaust fan for exhausting the air pollution to the outdoor field, and at the same time, intelligently issues another control command to a fan of a filtration device for rapidly guiding the air pollution to pass through a filter element for filtration and purification, thereby controlling a gas state of the bathroom space at a level of air pollution close to zero.

In a broader aspect of the present disclosure, an air pollution prevention system for bathroom space is provided. The system includes a plurality of gas detectors disposed in an outdoor field for detecting air pollution and outputting outdoor air pollution information, and disposed in a bathroom space for detecting air pollution and outputting indoor air pollution information; at least one filtration device disposed in the bathroom space for filtering the air pollution in the bathroom space; at least one exhaust fan disposed in the bathroom space for guiding and exhausting the air pollution in the bathroom space to the outdoor field and forming a gas exchanging of the bathroom space; and a cloud computing server receiving and storing the outdoor air pollution information of the outdoor field and the indoor air pollution information of the bathroom space to form a database of air pollution data, wherein when a value of the air pollution information exceeds a safety detection value, the cloud computing server intelligently selects and issues a control command for enabling the at least one exhaust fan to guide the air pollution to exhaust to the outdoor field and controlling the gas exchanging of the bathroom space to adjust a temperature and a humidity thereof, and simultaneously, performs an artificial intelligence computing for determining a location of the air pollution and intelligently selects and issues another control command for enabling the at least one filtration device to rapidly guide the air pollution in the bathroom space to pass through the filtration device for filtration and purification, thereby controlling a gas state of the bathroom space at a level of air pollution close to zero.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
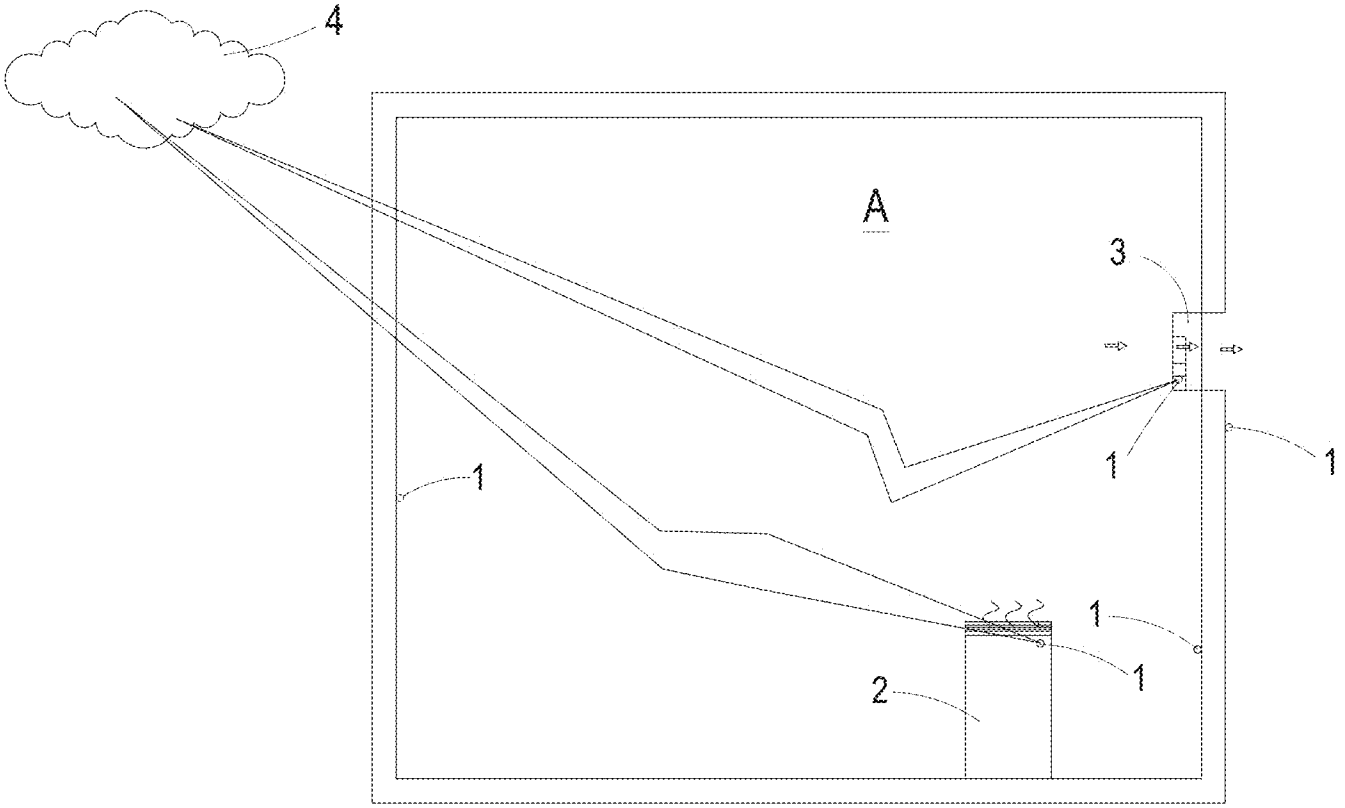
FIG. 1A is a schematic view illustrating an air pollution prevention system for bathroom space according to an embodiment of the present disclosure.
Figure 1B:
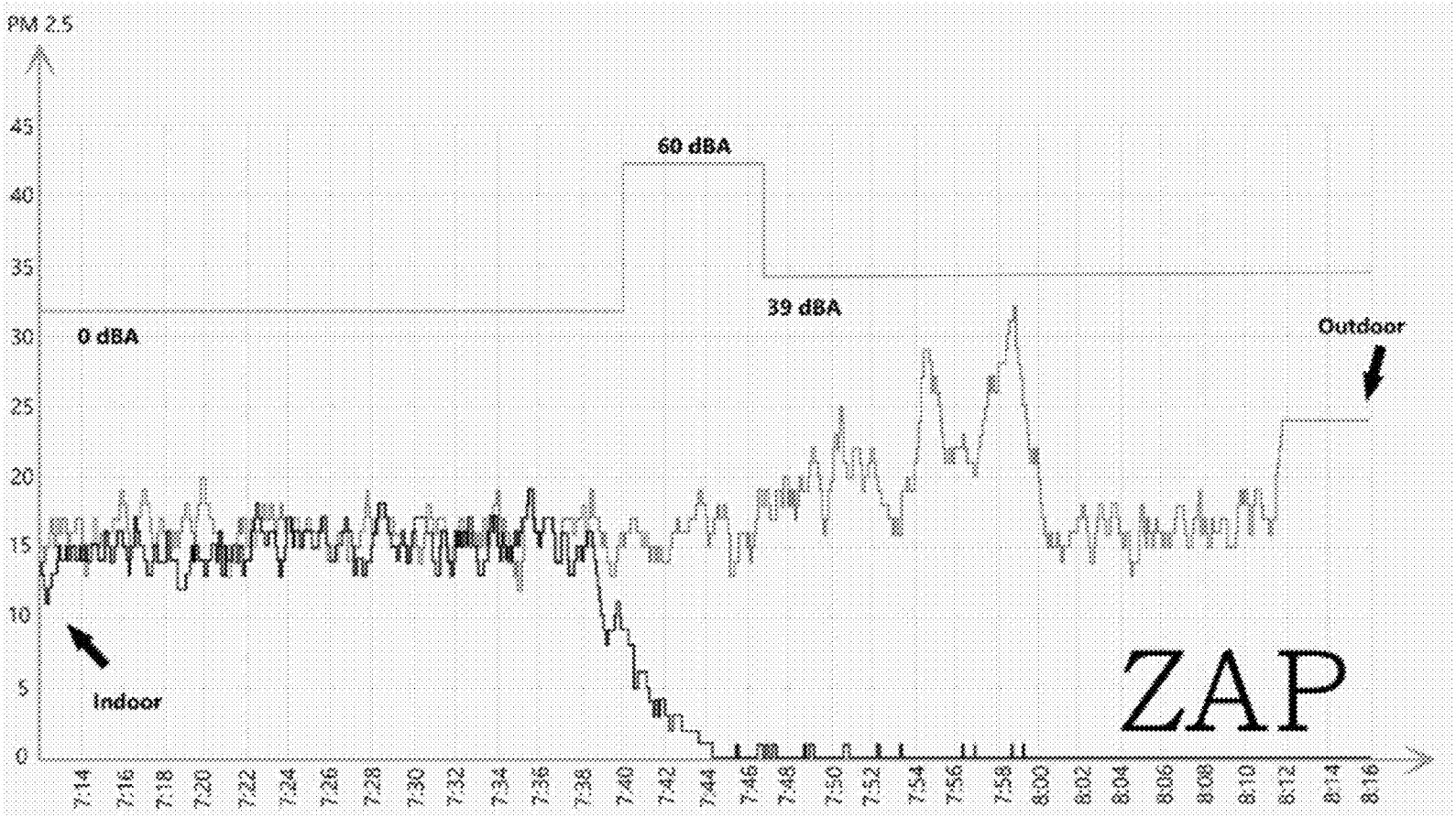
FIG. 1B is a graph showing a tendency of the air pollution gradually close to zero in the usage of the air pollution prevention system for bathroom space according to the embodiment of the present disclosure.

Please refer to FIG. 1A and FIG. 1B. The present disclosure is related to an air pollution prevention system for bathroom space including a plurality of gas detectors 1, at least one filtration device 2, at least one exhaust fan 3 and a cloud computing server 4.

Figure 3A:
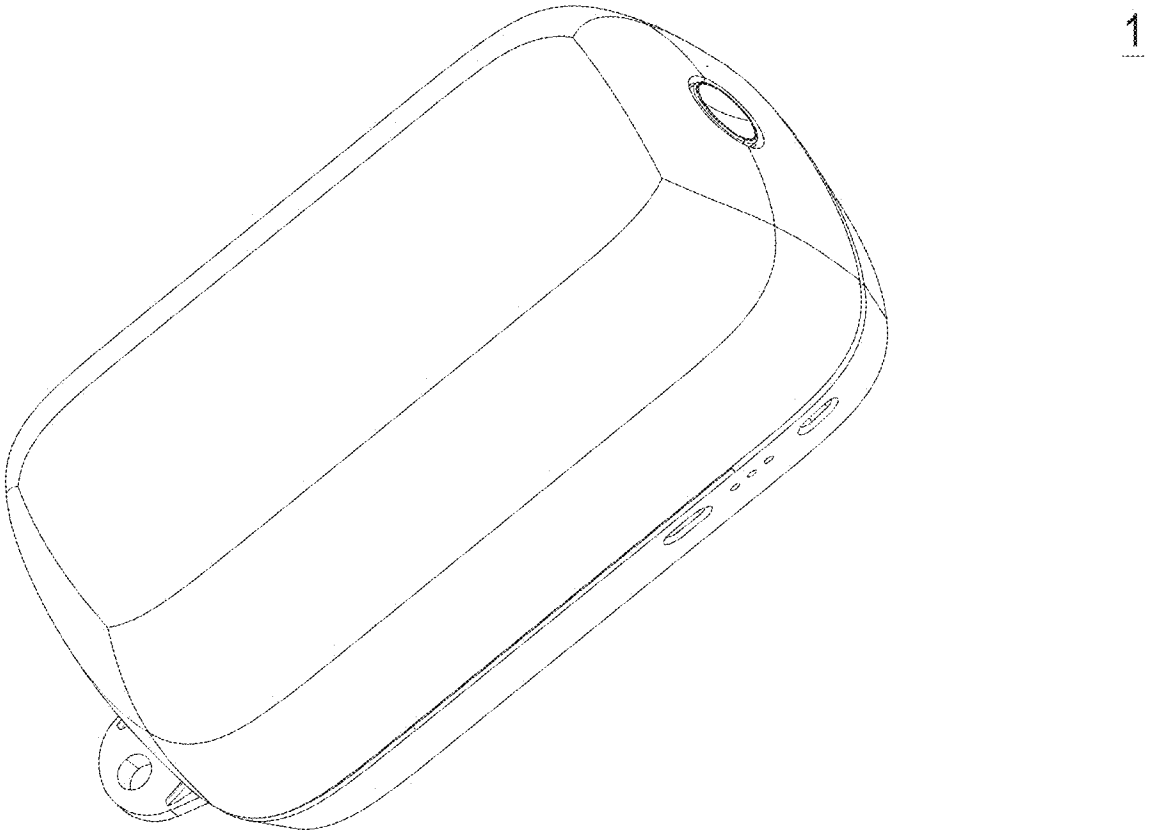
FIG. 3A is a schematic perspective view illustrating a gas detector according to the embodiment of the present disclosure.
Figure 3B:
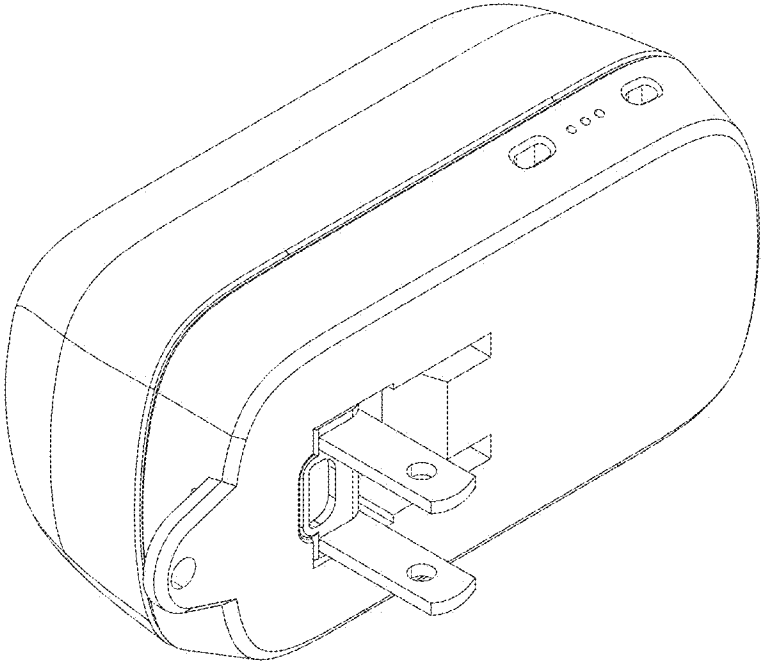
FIG. 3B is a schematic perspective view illustrating the gas detector according to the embodiment of the present disclosure from another angle.
Figure 3C:
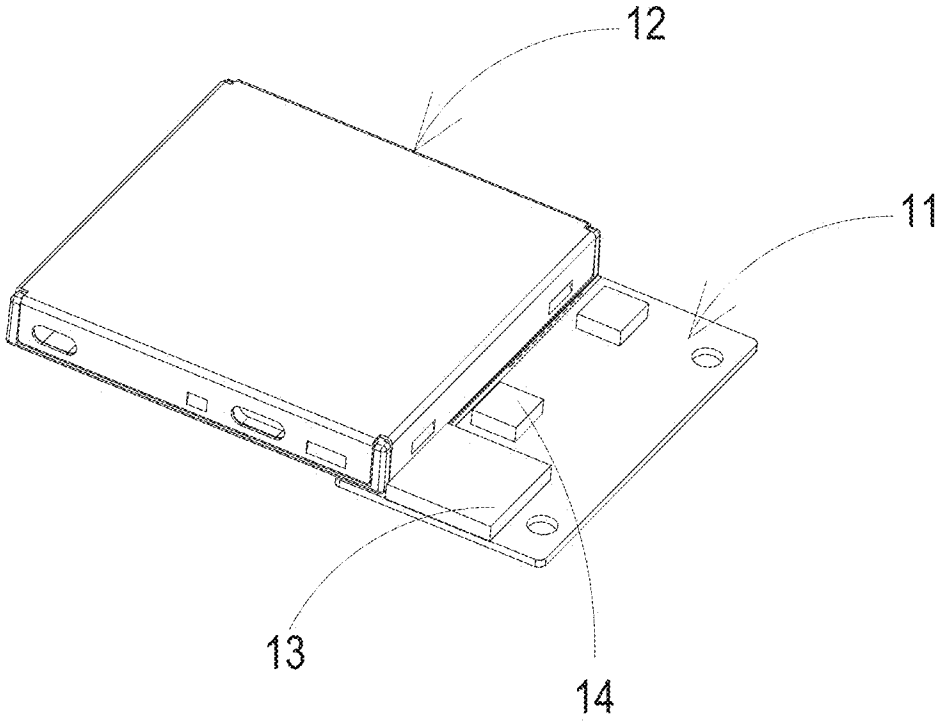
FIG. 3C is a schematic perspective view illustrating a gas detection module installed inside the gas detector according to the embodiment of the present disclosure.
Figure 4A:
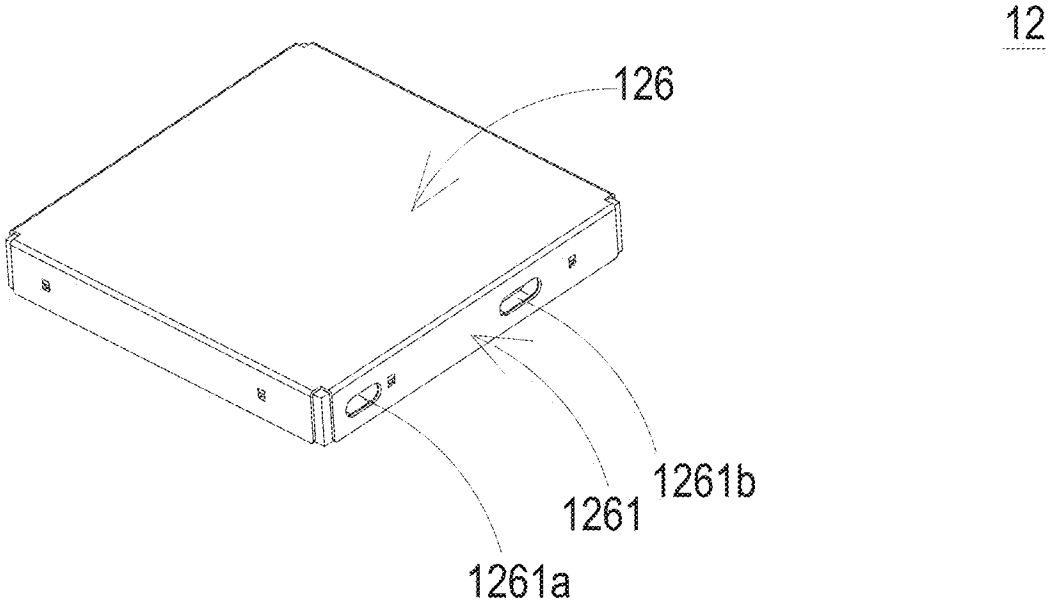
FIG. 4A is a schematic perspective view (1) illustrating a gas detection main part according to the embodiment of the present disclosure.
Figure 4B:
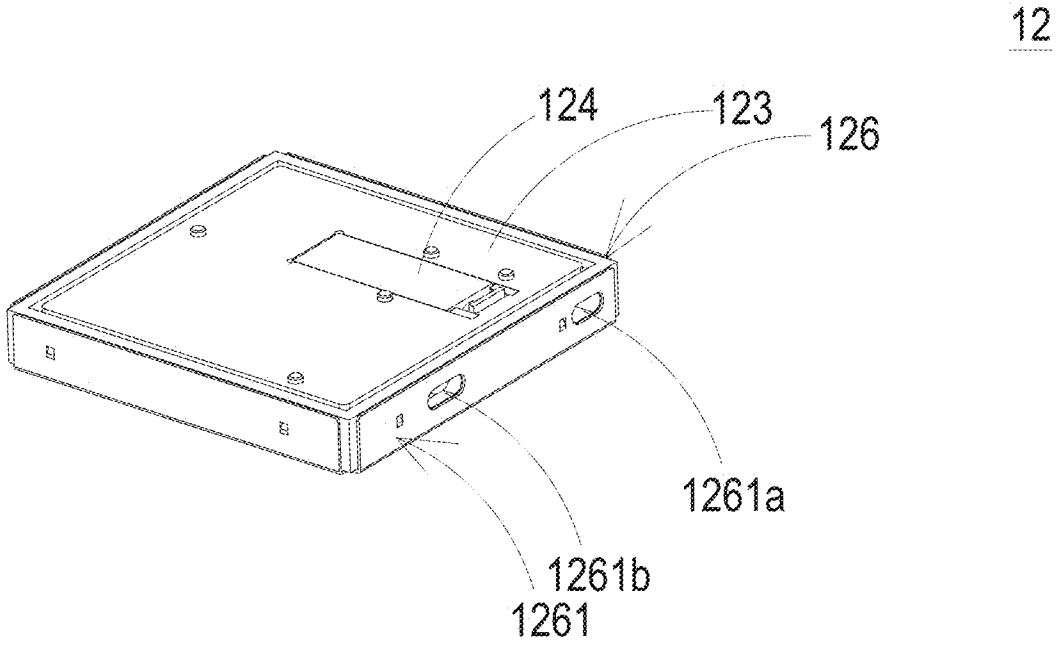
FIG. 4B is a schematic perspective view (2) illustrating the gas detection main part according to the embodiment of the present disclosure.
Figure 4C:
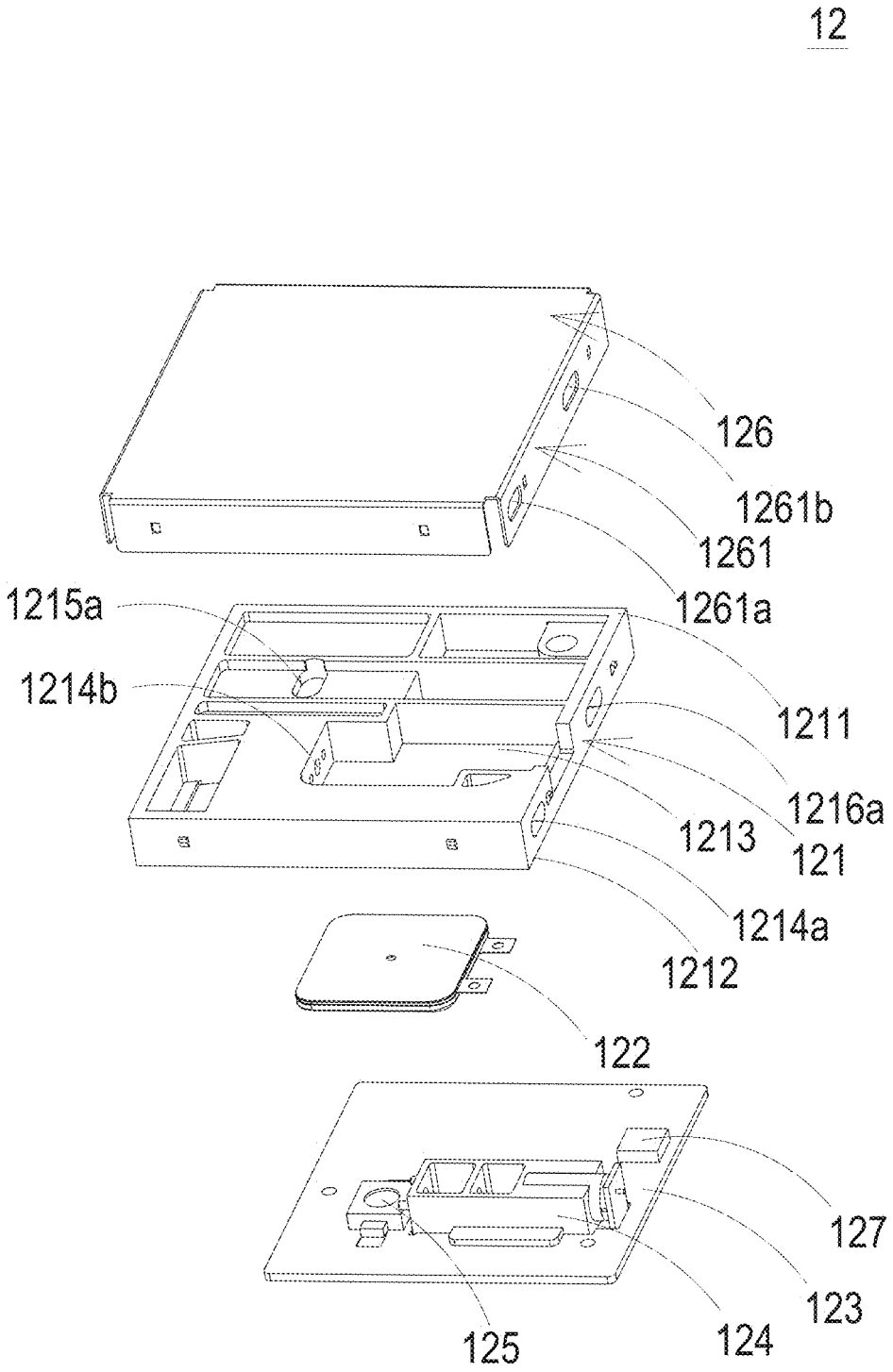
FIG. 4C is an exploded view illustrating the gas detection main part according to the embodiment of the present disclosure.
Figure 5A:
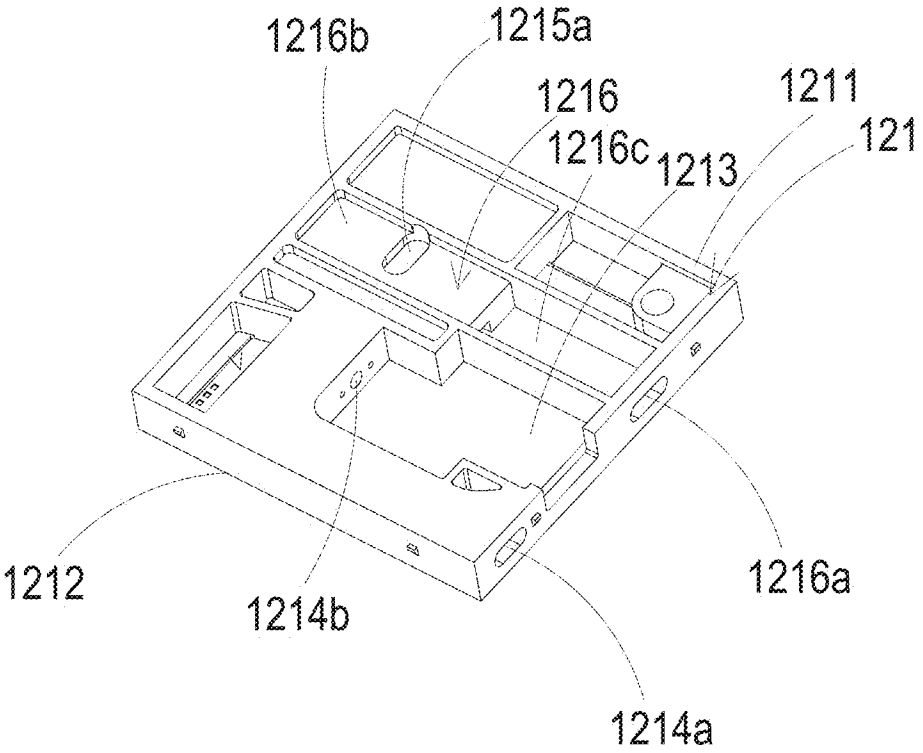
FIG. 5A is a schematic perspective view (1) illustrating a base according to the embodiment of the present disclosure.
Figure 5B:
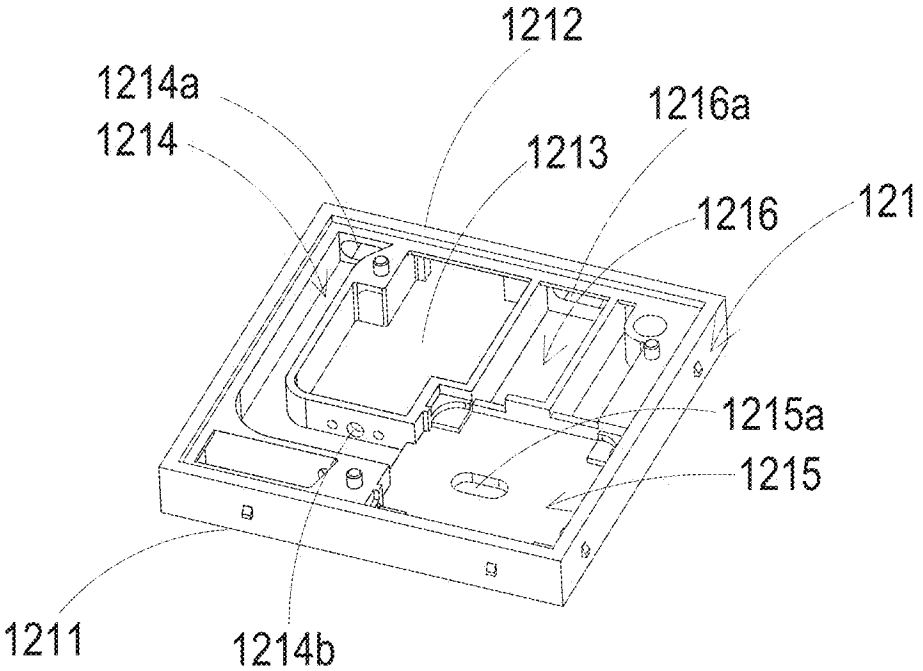
FIG. 5B is a schematic perspective view (2) illustrating the base according to the embodiment of the present disclosure.
Figure 6:
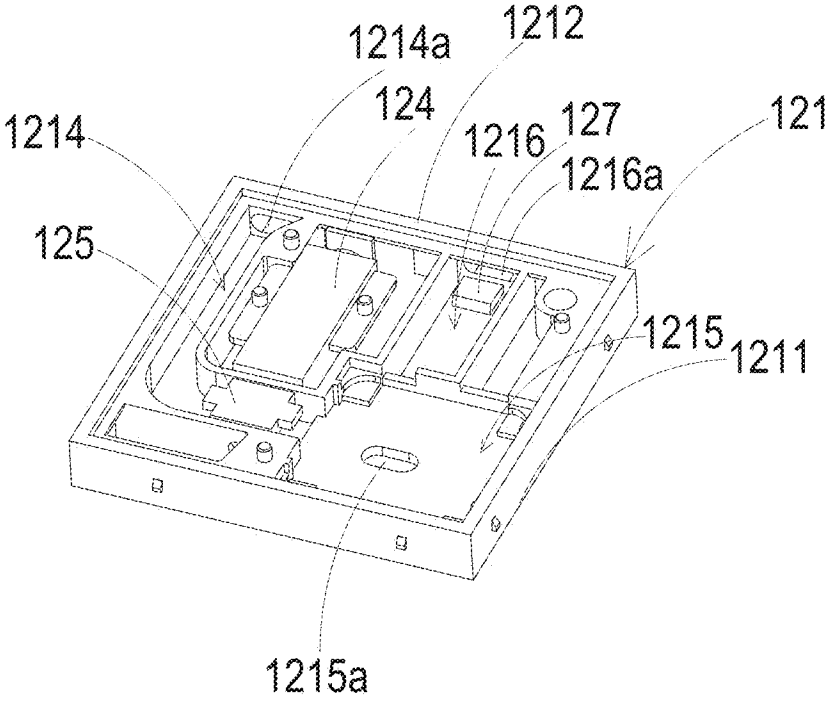
FIG. 6 is a schematic view (3) illustrating the base according to the embodiment of the present disclosure.
Figure 7A:
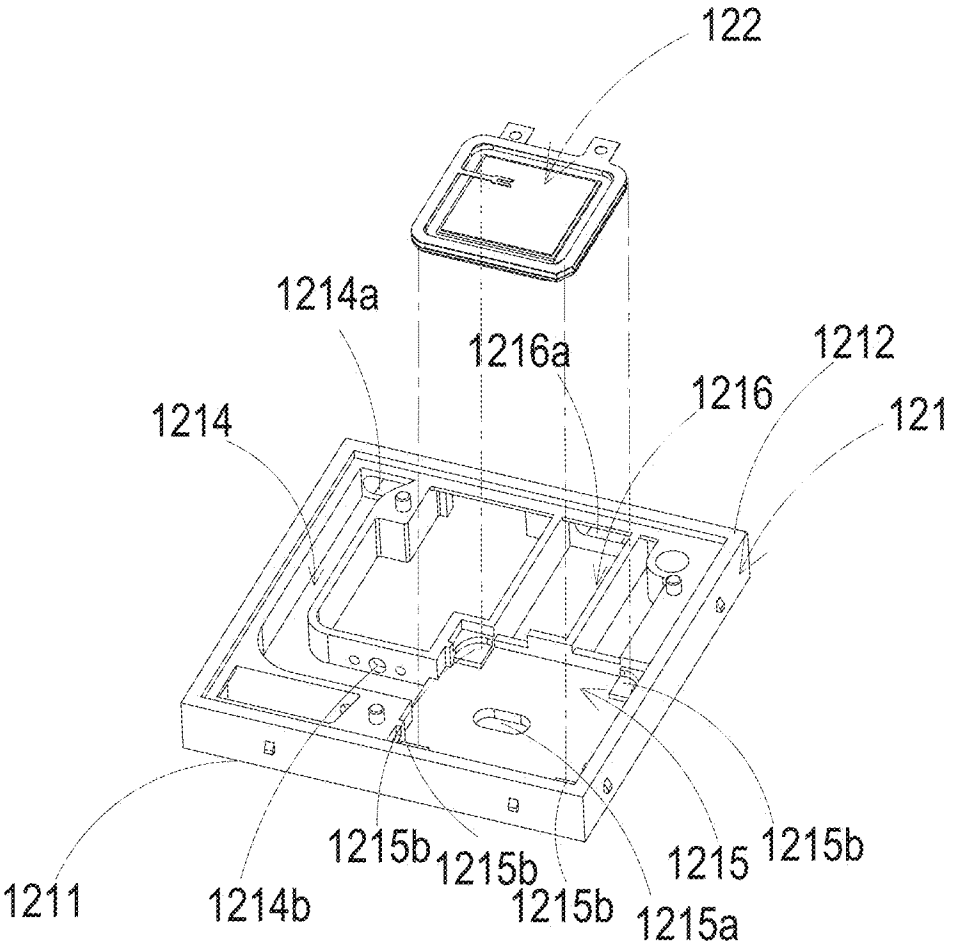
FIG. 7A is a schematic exploded view illustrating the combination of a piezoelectric actuator and the base according to the embodiment of the present disclosure.
Figure 7B:
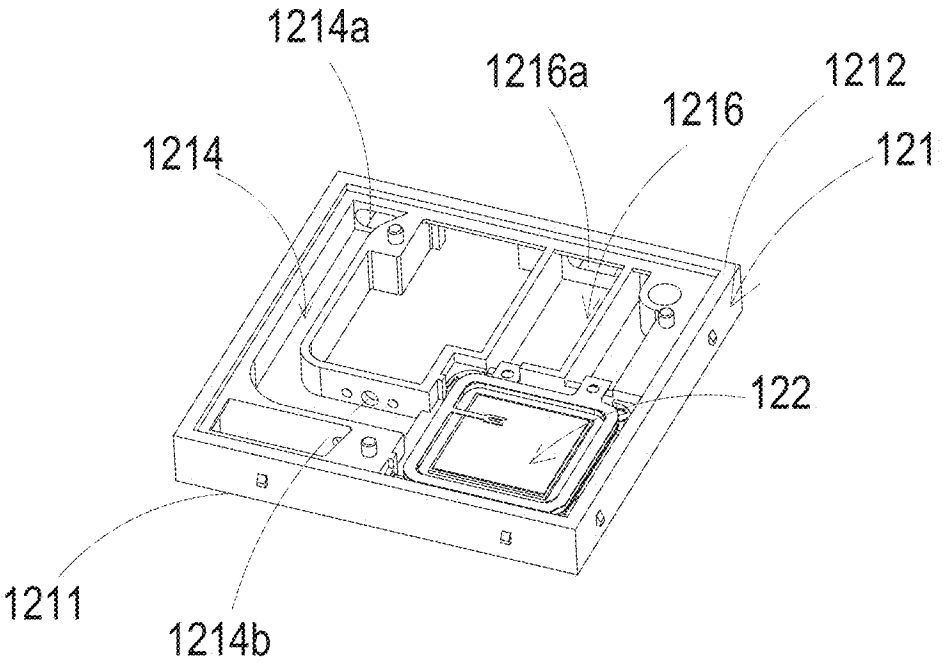
FIG. 7B is a schematic perspective view illustrating the combination of the piezoelectric actuator and the base according to the embodiment of the present disclosure.
Figure 8A:
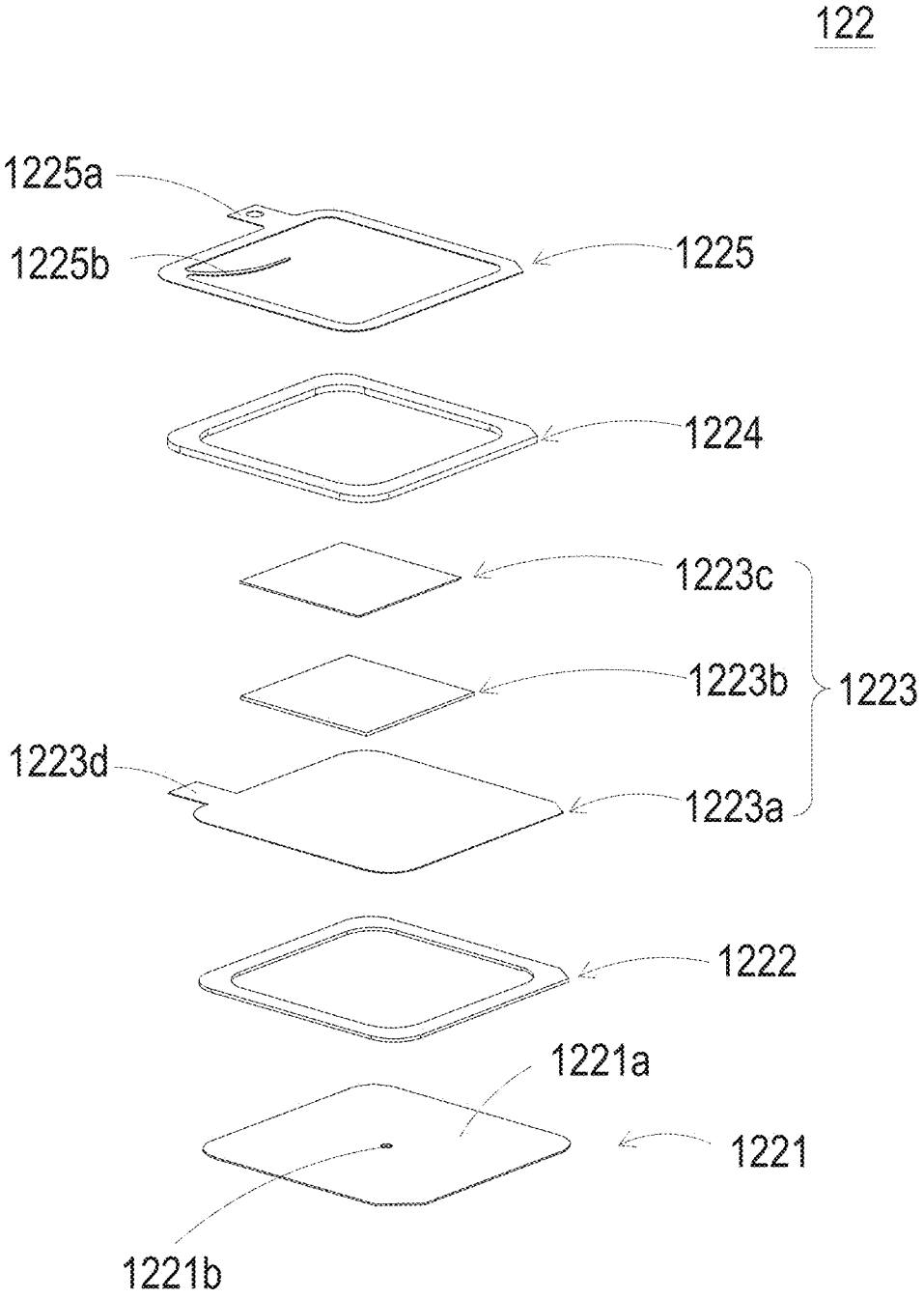
FIG. 8A is a schematic exploded view (1) illustrating the piezoelectric actuator according to the embodiment of the present disclosure.
Figure 8B:
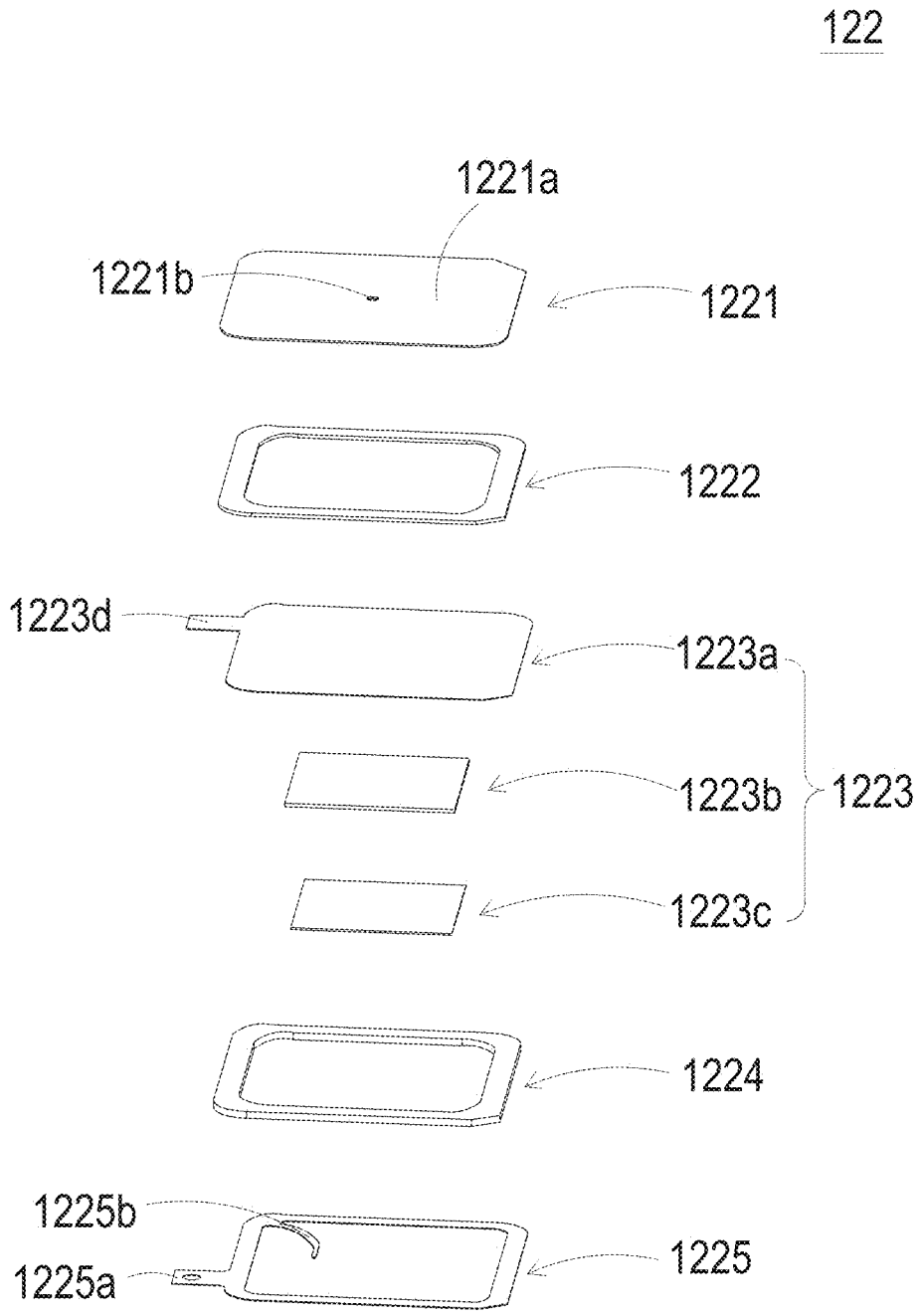
FIG. 8B is a schematic exploded view (2) illustrating the piezoelectric actuator according to the embodiment of the present disclosure.
Figure 11:
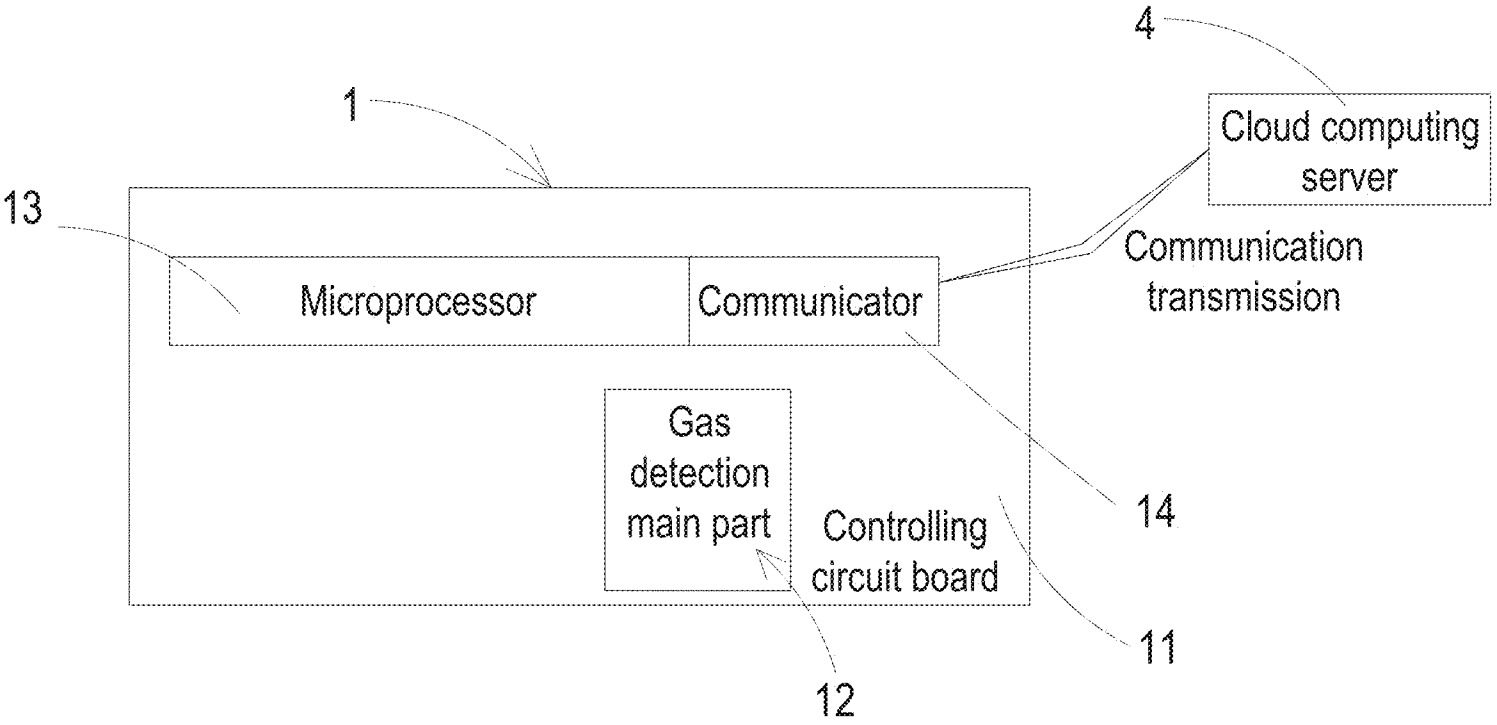
FIG. 11 is a block diagram illustrating the communication of the gas detector according to the embodiment of the present disclosure.

The plurality of gas detectors 1 described above are disposed in an outdoor field for detecting air pollution and outputting outdoor air pollution information and disposed in a bathroom space for detecting air pollution thereinside and outputting indoor air pollution information. In the embodiment, the gas detector 1 includes a gas detection module installed therein. As shown in FIG. 3C and FIG. 11, the gas detection module includes a controlling circuit board 11, a gas detection main part 12, a microprocessor 13 and a communicator 14. Notably, as shown in FIG. 3A and FIG. 3B, the gas detector I can be configured with an external power terminal, and the external power terminal can be directly inserted into the power interface in the bathroom space A for enabling the detection of air pollution. Alternatively, as shown in FIG. 1A and FIG. 3C, the gas detection module without external power supply terminals is directly disposed on the device (the filtration device 2, the exhaust fan 3) and connected to the power supply for enabling the detection of air pollution. That is, the gas detector I can be embedded in the filtration device 2 and connected with the operation of the filtration device 2, or alternatively, can be embedded in the exhaust fan 3 and connected with the operation of the exhaust fan 3. Notably, in the embodiment, the air pollution includes at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

Figure 2A:
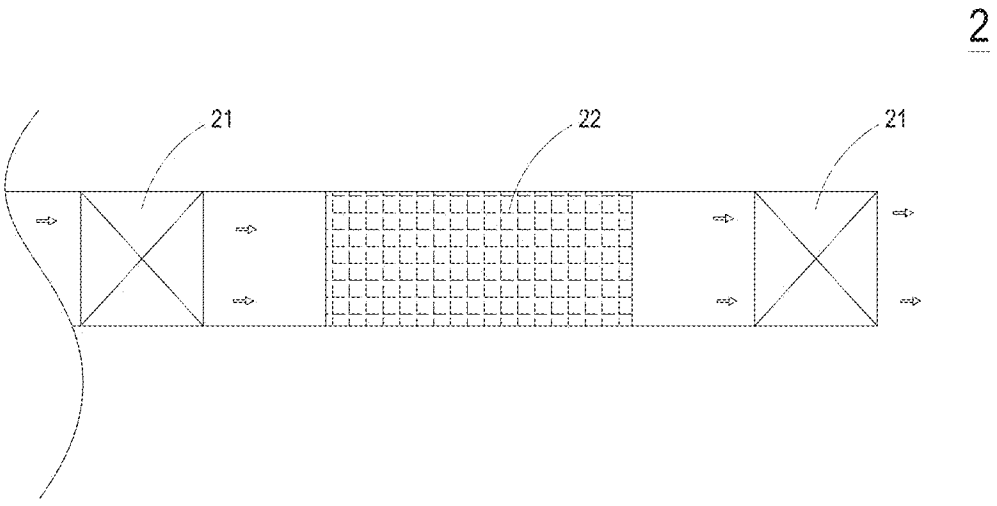
FIG. 2A is a schematic view illustrating the combination of a filtration device according to the embodiment of the present disclosure.
Figure 2B:
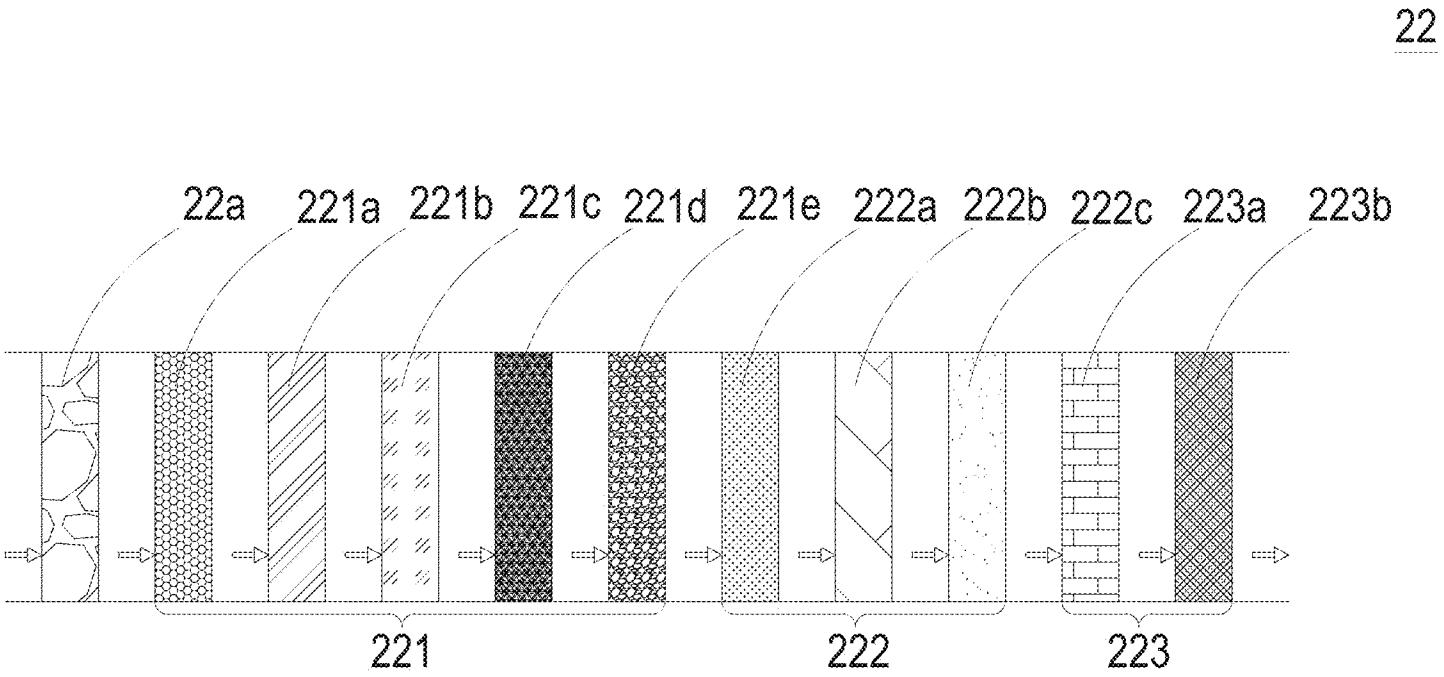
FIG. 2B is a schematic view illustrating the combination of a filter element of the filtration device according to the embodiment of the present disclosure.

As shown in FIG. 1A and FIG. 2A, the at least one filtration device 2, which is disposed in the bathroom space A, includes a fan 21 and a filter element 22. The fan 21 is enabled to guide the air pollution in the bathroom space A to pass through the filter element 22 for filtration and purification. Notably, the gas detector 1 is connected with the operation of the fan 21 of the filtration device 2. That is, after receiving a control command, the gas detector 1 controls the enablement of the fan 21 and the rotation speed of the fan 21. As shown in FIG. 2A, the airflow of the fan 21 flows in the path indicated by the arrows. The fan 21 can be arranged at the front side of the filter element 22, and the fan 21 can also be arranged at the rear side of the filter element 22. In the embodiment, as shown in FIG. 2B, the filter element 22 includes a filter screen which purifies the air pollution through physical blocking and absorption. The filter screen can be a high efficiency particulate air (HEPA) filter screen 22*a*, which is configured to absorb the chemical smoke, the bacteria, the dust particles and the pollen contained in the air pollution, so that the introduced air pollution is filtered and purified to achieve the effect of filtration and purification. Notably, in the embodiment, the filter element 22 can be the HEPA filter screen 22*a* coating with a decomposition layer 221 for purifying the air pollution in chemical means. Preferably but not exclusively, the decomposition layer 221 includes an activated carbon 221*a* configured to remove organic and inorganic substances in the air pollution, and remove colored and odorous substances. Preferably but not exclusively, the decomposition layer 221 includes a cleansing factor containing chlorine dioxide layer 221*b* configured to inhibit viruses, bacteria, fungi, influenza A, influenza B, enterovirus and norovirus in the air pollution, and the inhibition ratio can reach 99% and more, thereby reducing the cross-infection of viruses. Preferably but not exclusively, the decomposition layer 221 includes an herbal protective layer 221*c* extracted from ginkgo and Japanese Rhus chinensis configured to resist allergy effectively and destroy a surface protein of influenza virus (such as HINI influenza virus) passing therethrough. Preferably but not exclusively, the decomposition layer 221 includes a silver ion 221*d* configured to inhibit viruses, bacteria and fungi contained in the air pollution. Preferably but not exclusively, the decomposition layer 221 includes a zeolite 221*e* configured to remove ammonia nitrogen, heavy metals, organic pollutants, Escherichia coli, phenol, chloroform and anionic surfactants. Furthermore, in some embodiments, the filter element 22 is combined with a light irradiation element 222 to purify in chemical means. Preferably but not exclusively, the light irradiation element 222 is a photo-catalyst unit including a photo catalyst 222*a* and an ultraviolet lamp 222*b*. When the photo catalyst 222*a* is irradiated by the ultraviolet lamp 222*b*, the light energy is converted into the electrical energy, thereby decomposing harmful substances and disinfects bacteria contained in the air pollution, so as to achieve the effects of filtration and purification. Preferably but not exclusively, the light irradiation element 222 is a photo-plasma unit including a nanometer irradiation tube 222*c*. When the introduced air pollution is irradiated by the nanometer irradiation tube 222*c*, the oxygen molecules and water molecules contained in the air pollution are decomposed into high oxidizing photo-plasma, and an ion flow capable of destroying organic molecules is generated. In that, volatile formaldehyde, volatile toluene and volatile organic compounds (VOC) contained in the air pollution are decomposed into water and carbon dioxide, so as to achieve the effects of filtration and purification. Moreover, in some embodiments, the filter element 22 is combined with a decomposition unit 223 to purify in chemical means. Preferably but not exclusively, the decomposition unit 223 is a negative ion unit 223*a* which makes the suspended particles carrying positive charges in the air pollution to adhere to negative charges, so as to achieve the effects of filtration and purification. Preferably but not exclusively, the decomposition unit 223 is a plasma ion unit 223*b*. The oxygen molecules and water molecules contained in the air pollution are decomposed into positive hydrogen ions ($H^+$) and negative oxygen ions ($O^{2-}$) by the plasma ion. The substances attached with water around the ions are adhered on the surfaces of viruses and bacteria and converted into OH radicals with extremely strong oxidizing power under chemical reactions, thereby removing hydrogen (H) from the protein on the surfaces of viruses and bacteria, and thus decomposing (oxidizing) the protein, so as to filter the introduced air pollution and achieve the effects of filtration and purification.

As shown in FIG. 1A, the exhaust fan 3, which is disposed in the bathroom space A, guides the air pollution in the bathroom space A to exhaust to the outdoor field and form a gas exchanging of the bathroom space A. Notably, the gas detector I is embedded in the exhaust fan 3 in a type of gas detection module and is connected with the operation of the exhaust fan 3. That is, the gas detector 1 controls the enablement of the exhaust fan 3 and the rotation speed of the exhaust fan 3 after receiving the control command.

In the embodiment, as shown in FIG. 1A, the cloud computing server 4 receives and stores the outdoor air pollution information of the outdoor field and the indoor air pollution information of the bathroom space A to form an database of air pollution data, and intelligently selects and issues a control command to enable the exhaust fan 3 for guiding the air pollution in the bathroom space A to exhaust to the outdoor field, and to control the air exchanging of the bathroom space A for adjusting the temperature and humidity, and simultaneously, determines a location of the air pollution through an artificial intelligence computing and intelligently selects and issues another control command for enabling the filtration device 2 to rapidly guide the air pollution to pass through the filtration device 2 for filtration and purification, thereby controlling a gas state of the bathroom space A at a level of air pollution close to zero.

Figure 12:
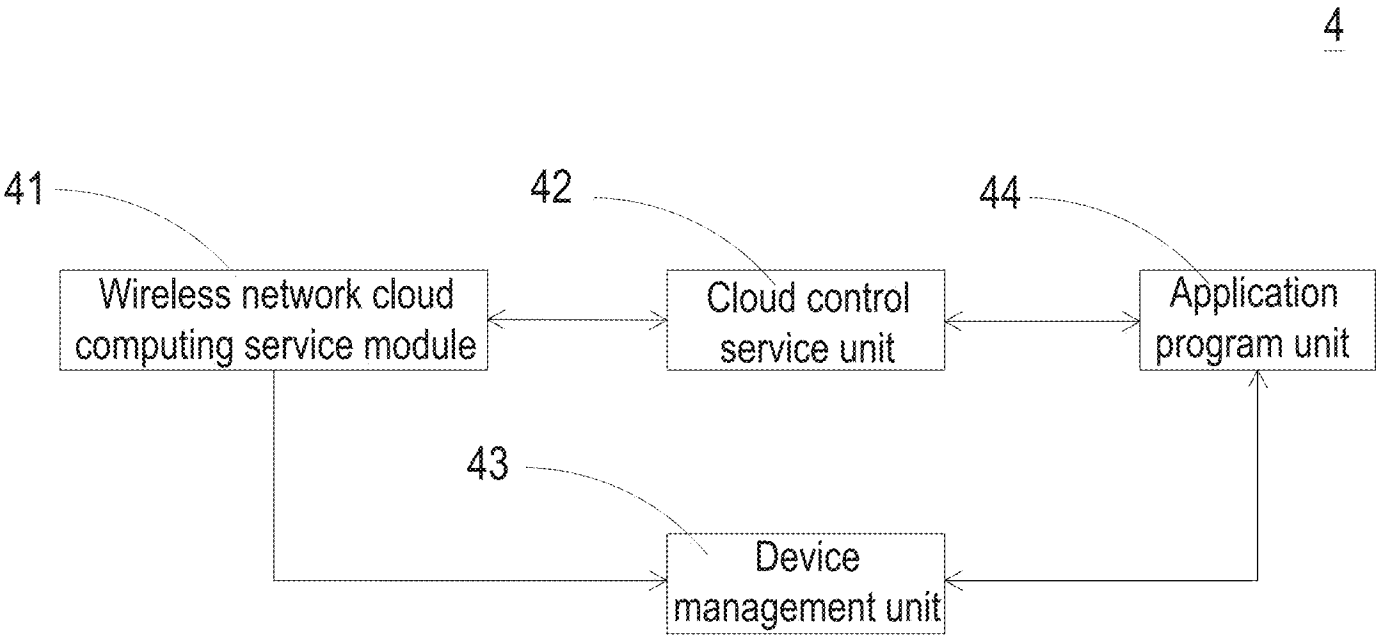
FIG. 12 is a block diagram showing the architecture of a cloud computing server according to the embodiment of the present disclosure.

Please refer to FIG. 12. In the embodiment, the cloud computing server 4 includes a wireless network cloud computing service module 41, a cloud control service unit 42, a device management unit 43 and an application program unit 44. The wireless network cloud computing service module 41 receives air pollution communication information of the outdoor field and the bathroom space A and transmits a control command. Moreover, the wireless network cloud computing service module 41 receives the air pollution information of the outdoor field and the bathroom space A and transmits thereof and the received air pollution communication information to the cloud control service unit 42 for storing and forming the database of air pollution data. An artificial intelligence computing and a comparison based on the database of air pollution data are performed to determine a location of the air pollution, and accordingly, the control command is transmitted to the wireless network cloud computing service module 41, and then transmitted to the filtration device and the exhaust fan 3 to control the enablement thereof through the wireless network cloud computing service module 41. The device management unit 43 receives communication information of the filtration device 2 and the exhaust fan 3 through the wireless network cloud computing service module 41 to manage the user login and device binding, and device management information can be provided to the application program unit 44 for system control and management. The application program unit 44 can also display and inform the air pollution information obtained from the cloud control service unit 42, so the user can know the real-time status of air pollution removal through the mobile phone or the communication device. Moreover, the user can control the operation of the air pollution prevention system for bathroom space through the application program unit 44 of the mobile phone or the communication device.

In view of the above descriptions, in the air pollution prevention system for bathroom space of the present disclosure, a plurality of gas detectors 1 are disposed in the bathroom space A and in the outdoor field, so that the gas detectors 1 can detect and determine the indoor air pollution and the outdoor air pollution, and respectively output the indoor air pollution information and the outdoor air pollution information. Then, the cloud computing server 4 receives and stores the air pollution information to form the database of air pollution data. If the air pollution information of the bathroom space A is higher than the outdoor air pollution information, the cloud computing server 4 issues a control command for enabling the exhaust fan 3 to guide the air pollution in the bathroom space A to exhaust to the outdoor field, and at the same time, intelligently selects and issues another control command for enabling the fan 21 of the filtration device 2 for rapidly guiding the air pollution of the bathroom space A to pass through the filter element 22 of the filtration device 2 for filtration and purification, thereby controlling the gas state in the bathroom space A at a level of air pollution close to zero.

Moreover, when the value of the air pollution information of the bathroom space A exceeds a safety detection value, which includes a detection value of $CO_2$, VOC, PM2.5, temperature and/or humidity, the cloud computing server 4 issues the control command to enable the exhaust fan 3 for controlling the gas exchanging of the bathroom space A and simultaneously adjusting the temperature and humidity of the bathroom space A.

Notably, the safety detection value described above includes at least one selected from the group consisting of a concentration of PM2.5 which is less than 10 $\mu g/m^3$, a concentration of carbon dioxide ($CO_2$) which is less than 1000 ppm, a concentration of total volatile organic compounds (TVOC) which is less than 0.56 ppm, a concentration of formaldehyde (HCHO) which is less than or equal to 0.08 ppm, a colony-forming unit of bacteria which is less than 1500 $CFU/m^3$, a colony-forming unit of fungi which is less than 1000 $CFU/m^3$, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, a concentration of lead which is less than or equal to 0.15 $\mu g/m^3$, and a relative humidity (RH %) which is ranged between 30 and 70.

In some other embodiments, as shown in FIG. 1A and FIG. 1B, take the plurality of gas detectors 1 disposed in the bathroom space A for detecting PM2.5 as an example. As the air pollution prevention system for bathroom space A is enabled by the user at 7:40, the value of PM2.5 in the bathroom space A is close to that in the outdoor field. At the time the air pollution prevention system for bathroom space A detects PM2.5, the cloud computing server 4 receives and computes at least two air pollution information detected by the plurality of gas detectors 1 and performs the intelligence computing to determine the location of the air pollution in the bathroom space A. Then, the cloud computing server 4 intelligently issues the control command to enable the fan 21 of the filtration device 2 for generating a directional airflow to rapidly guide the air pollution to pass through the filter element 22 for filtration and purification. At 7:44, the value of air pollution of the bathroom space A is rapidly dropped and kept at a level close to zero.

In order to understand the air pollution prevention system for bathroom space of the present disclosure, the structure of the gas detection module of the gas detector 1 is described in detail below.

The gas detector includes a gas detection module installed therein. The gas detection module includes a controlling circuit board 11, a gas detection main part 12, a microprocessor 13 and a communicator 14. The gas detection main part 12, the microprocessor 13 and the communicator 14 are integrally packaged on the controlling circuit board 11 and electrically connected to each other. In the embodiment, the microprocessor 13 and the communicator 14 are mounted on the controlling circuit board 11. The microprocessor 13 controls the driving signal of the gas detection main part 12 for enabling the detection. In this way, the gas detection main part 12 detects the air pollution and outputs the air pollution information, and the microprocessor 13 receives, processes and provides the air pollution information to the communicator 14 for externally transmitting to the cloud computing server 4.

Please refer to FIG. 4A to FIG. 9A. The gas detection main part 12 includes a base 121, a piezoelectric actuator 122, a driving circuit board 123, a laser component 124, a particulate sensor 125, and an outer cover 126. In the embodiment, the base 121 includes a first surface 1211, a second surface 1212, a laser loading region 1213, a gas-inlet groove 1214, a gas-guiding-component loading region 1215 and a gas-outlet groove 1216. The first surface 1211 and the second surface 1212 are two surfaces opposite to each other. The laser loading region 1213 is hollowed out from the first surface 1211 toward the second surface 1212. The outer cover 126 covers the base 121 and includes a side plate 1261. The side plate 1261 has an inlet opening 1261*a* and an outlet opening 1261*b*. The gas-inlet groove 1214 is concavely formed from the second surface 1212 and disposed adjacent to the laser loading region 1213. The gas-inlet groove 1214 includes a gas-inlet 1214*a* and two lateral walls. The gas-inlet 1214*a* is in communication with an environment outside the base 121, and is spatially corresponding in position to the inlet opening 1261*a* of the outer cover 126. Two transparent windows 1214*b* are opened on the two lateral walls of the gas-inlet groove 1214 and are in communication with the laser loading region 1213. Therefore, the first surface 1211 of the base 121 is covered and attached by the outer cover 126, and the second surface 1212 is covered and attached by the driving circuit board 123, so that an inlet path is defined by the gas-inlet groove 1214.

In the embodiment, the gas-guiding-component loading region 1215 is concavely formed from the second surface 1212 and in communication with the gas-inlet groove 1214. A ventilation hole 1215*a* penetrates a bottom surface of the gas-guiding-component loading region 1215. The gas-guiding-component loading region 1215 includes four positioning protrusions 1215*b* disposed at four corners of the gas-guiding-component loading region 1215, respectively. In the embodiment, the gas-outlet groove 1216 includes a gas-outlet 1216*a*, and the gas-outlet 1216*a* is spatially corresponding to the outlet opening 1261*b* of the outer cover 126. The gas-outlet groove 1216 includes a first section 1216*b* and a second section 1216*c*. The first section 1216*b* is concavely formed out from the first surface 1211 in a region spatially corresponding to a vertical projection area of the gas-guiding-component loading region 1215. The second section 1216*c* is hollowed out from the first surface 1211 to the second surface 1212 in a region where the first surface 1211 is extended from the vertical projection area of the gas-guiding-component loading region 1215. The first section 1216*b* and the second section 1216*c* are connected to form a stepped structure. Moreover, the first section 1216*b* of the gas-outlet groove 1216 is in communication with the ventilation hole 1215*a* of the gas-guiding-component loading region 1215, and the second section 1216*c* of the gas-outlet groove 1216 is in communication with the gas-outlet 1216*a*. In that, when first surface 1211 of the base 121 is attached and covered by the outer cover 126 and the second surface 1212 of the base 121 is attached and covered by the driving circuit board 123, the gas-outlet groove 1216 and the driving circuit board 123 collaboratively define an outlet path.

In the embodiment, the laser component 124 and the particulate sensor 125 are disposed on and electrically connected to the driving circuit board 123 and located within the base 121. In order to clearly describe and illustrate the positions of the laser component 124 and the particulate sensor 125 in the base 121, the driving circuit board 123 is intentionally omitted. The laser component 124 is accommodated in the laser loading region 1213 of the base 121, and the particulate sensor 125 is accommodated in the gas-inlet groove 1214 of the base 121 and is aligned to the laser component 124. In addition, the laser component 124 is spatially corresponding to the transparent window 1214*b*, so that a light beam emitted by the laser component 124 passes through the transparent window 1214*b* and is irradiated into the gas-inlet groove 1214. A light beam path emitted from the laser component 124 passes through the transparent window 1214*b* and extends in an orthogonal direction perpendicular to the gas-inlet groove 1214. In the embodiment, a projecting light beam emitted from the laser component 124 passes through the transparent window 1214*b* and enters the gas-inlet groove 1214 to irradiate the suspended particles contained in the gas passing through the gas-inlet groove 1214. When the suspended particles contained in the gas are irradiated and generate scattered light spots, the scattered light spots are received and calculated by the particulate sensor 125, which is in an orthogonal direction perpendicular to the gas-inlet groove 1214, to obtain the gas detection data.

In the embodiment, the piezoelectric actuator 122 is accommodated in the square-shaped gas-guiding-component loading region 1215 of the base 121. In addition, the gas-guiding-component loading region 1215 is in fluid communication with the gas-inlet groove 1214. When the piezoelectric actuator 122 is enabled, the gas in the gas-inlet groove 1214 is inhaled by the piezoelectric actuator 122, so that the gas flows into the piezoelectric actuator 122, and is transported into the gas-outlet groove 1216 through the ventilation hole 1215*a* of the gas-guiding-component loading region 1215. Moreover, the driving circuit board 123 covers the second surface 1212 of the base 121, and the laser component 124 is positioned and disposed on the driving circuit board 123, and is electrically connected to the driving circuit board 123. The particulate sensor 125 is also positioned and disposed on the driving circuit board 123 and electrically connected to the driving circuit board 123. In that, when the outer cover 126 covers the base 121, the inlet opening 1261*a* is spatially corresponding to the gas-inlet 1214*a* of the base 121, and the outlet opening 1261*b* is spatially corresponding to the gas-outlet 1216*a* of the base 121.

In the embodiment, the piezoelectric actuator 122 includes a gas-injection plate 1221, a chamber frame 1222, an actuator element 1223, an insulation frame 1224 and a conductive frame 1225. In the embodiment, the gas-injection plate 1221 is made by a flexible material and includes a suspension plate 1221*a* and a hollow aperture 1221*b*. The suspension plate 1221*a* is a sheet structure and is permitted to undergo a bending deformation. Preferably but not exclusively, the shape and the size of the suspension plate 1221*a* are corresponding to the inner edge of the gas-guiding-component loading region 1215, but not limited thereto. The hollow aperture 1221*b* passes through a center of the suspension plate 1221*a*, so as to allow the gas to flow therethrough. Preferably but not exclusively, in the embodiment, the shape of the suspension plate 1221*a* is selected from the group consisting of a square, a circle, an ellipse, a triangle and a polygon, but not limited thereto.

In the embodiment, the chamber frame 1222 is carried and stacked on the gas-injection plate 1221. In addition, the shape of the chamber frame 1222 is corresponding to the gas-injection plate 1221. The actuator element 1223 is carried and stacked on the chamber frame 1222 and collaboratively defines a resonance chamber 1226 with the chamber frame 1222 and the gas-injection plate 1221. The insulation frame 1224 is carried and stacked on the actuator element 1223 and the appearance of the insulation frame 1224 is similar to that of the chamber frame 1222. The conductive frame 1225 is carried and stacked on the insulation frame 1224, and the appearance of the conductive frame 1225 is similar to that of the insulation frame 1224. In addition, the conductive frame 1225 includes a conducting pin 1225*a* and a conducting electrode 1225*b*. The conducting pin 1225*a* is extended outwardly from an outer edge of the conductive frame 1225, and the conducting electrode 1225*b* is extended inwardly from an inner edge of the conductive frame 1225. Moreover, the actuator element 1223 further includes a piezoelectric carrying plate 1223*a*, an adjusting resonance plate 1223*b* and a piezoelectric plate 1223*c*. The piezoelectric carrying plate 1223*a* is carried and stacked on the chamber frame 1222. The adjusting resonance plate 1223*b* is carried and stacked on the piezoelectric carrying plate 1223*a*. The piezoelectric plate 1223*c* is carried and stacked on the adjusting resonance plate 1223*b*. The adjusting resonance plate 1223*b* and the piezoelectric plate 1223*c* are accommodated in the insulation frame 1224. The conducting electrode 1225*b* of the conductive frame 1225 is electrically connected to the piezoelectric plate 1223*c*. In the embodiment, the piezoelectric carrying plate 1223*a* and the adjusting resonance plate 1223*b* are made by a conductive material. The piezoelectric carrying plate 1223*a* includes a piezoelectric pin 1223*d*. The piezoelectric pin 1223*d* and the conducting pin 1225*a* are electrically connected to a driving circuit (not shown) on the driving circuit board 123, so as to receive a driving signal, such as a driving frequency and a driving voltage. Through this structure, a circuit is formed by the piezoelectric pin 1223*d*, the piezoelectric carrying plate 1223*a*, the adjusting resonance plate 1223*b*, the piezoelectric plate 1223*c*, the conducting electrode 1225*b*, the conductive frame 1225 and the conducting pin 1225*a* for transmitting the driving signal. Moreover, the insulation frame 1224 is insulated between the conductive frame 1225 and the actuator element 1223, so as to avoid the occurrence of a short circuit. Thereby, the driving signal is transmitted to the piezoelectric plate 1223*c*. After receiving the driving signal, the piezoelectric plate 1223*c* deforms due to the piezoelectric effect, and the piezoelectric carrying plate 1223*a* and the adjusting resonance plate 1223*b* are further driven to generate the bending deformation in the reciprocating manner.

Furthermore, in the embodiment, the adjusting resonance plate 1223*b* is located between the piezoelectric plate 1223*c* and the piezoelectric carrying plate 1223*a* and served as a cushion between the piezoelectric plate 1223*c* and the piezoelectric carrying plate 1223*a*. Thereby, the vibration frequency of the piezoelectric carrying plate 1223*a* is adjustable. Basically, the thickness of the adjusting resonance plate 1223*b* is greater than the thickness of the piezoelectric carrying plate 1223*a*, and the vibration frequency of the actuator element 1223 can be adjusted by adjusting the thickness of the adjusting resonance plate 1223*b*.

Please further refer to FIG. 7A, FIG. 7B, FIG. 8A, FIG. 8B and FIG. 9A. In the embodiment, the gas-injection plate 1221, the chamber frame 1222, the actuator element 1223, the insulation frame 1224 and the conductive frame 1225 are stacked and positioned in the gas-guiding-component loading region 1215 sequentially, so that the piezoelectric actuator 122 is supported and positioned in the gas-guiding-component loading region 1215. A clearance 1221*c* is defined between the suspension plate 1221*a* and an inner edge of the gas-guiding-component loading region 1215 for gas flowing therethrough. In the embodiment, a flowing chamber 1227 is formed between the gas-injection plate 1221 and the bottom surface of the gas-guiding-component loading region 1215. The flowing chamber 1227 is in communication with the resonance chamber 1226 between the actuator element 1223, the chamber frame 1222 and the gas-injection plate 1221 through the hollow aperture 1221*b* of the gas-injection plate 1221. By controlling the vibration frequency of the gas in the resonance chamber 1226 to be close to the vibration frequency of the suspension plate 1221*a*, the Helmholtz resonance effect is generated between the resonance chamber 1226 and the suspension plate 1221*a*, so as to improve the efficiency of gas transportation. When the piezoelectric plate 1223*c* is moved away from the bottom surface of the gas-guiding-component loading region 1215, the suspension plate 1221*a* of the gas-injection plate 1221 is driven to move away from the bottom surface of the gas-guiding-component loading region 1215 by the piezoelectric plate 1223*c*. In that, the volume of the flowing chamber 1227 is expanded rapidly, the internal pressure of the flowing chamber 1227 is decreased to form a negative pressure, and the gas outside the piezoelectric actuator 122 is inhaled through the clearance 1221*c* and enters the resonance chamber 1226 through the hollow aperture 1221*b*. Consequently, the pressure in the resonance chamber 1226 is increased to generate a pressure gradient. When the suspension plate 1221*a* of the gas-injection plate 1221 is driven by the piezoelectric plate 1223*c* to move toward the bottom surface of the gas-guiding-component loading region 1215, the gas in the resonance chamber 1226 is discharged out rapidly through the hollow aperture 1221*b*, and the gas in the flowing chamber 1227 is compressed, thereby the converged gas is quickly and massively ejected out of the flowing chamber 1227 under the condition close to an ideal gas state of the Bernoulli's law, and transported to the ventilation hole 1215*a* of the gas-guiding-component loading region 1215.

Figure 9A:
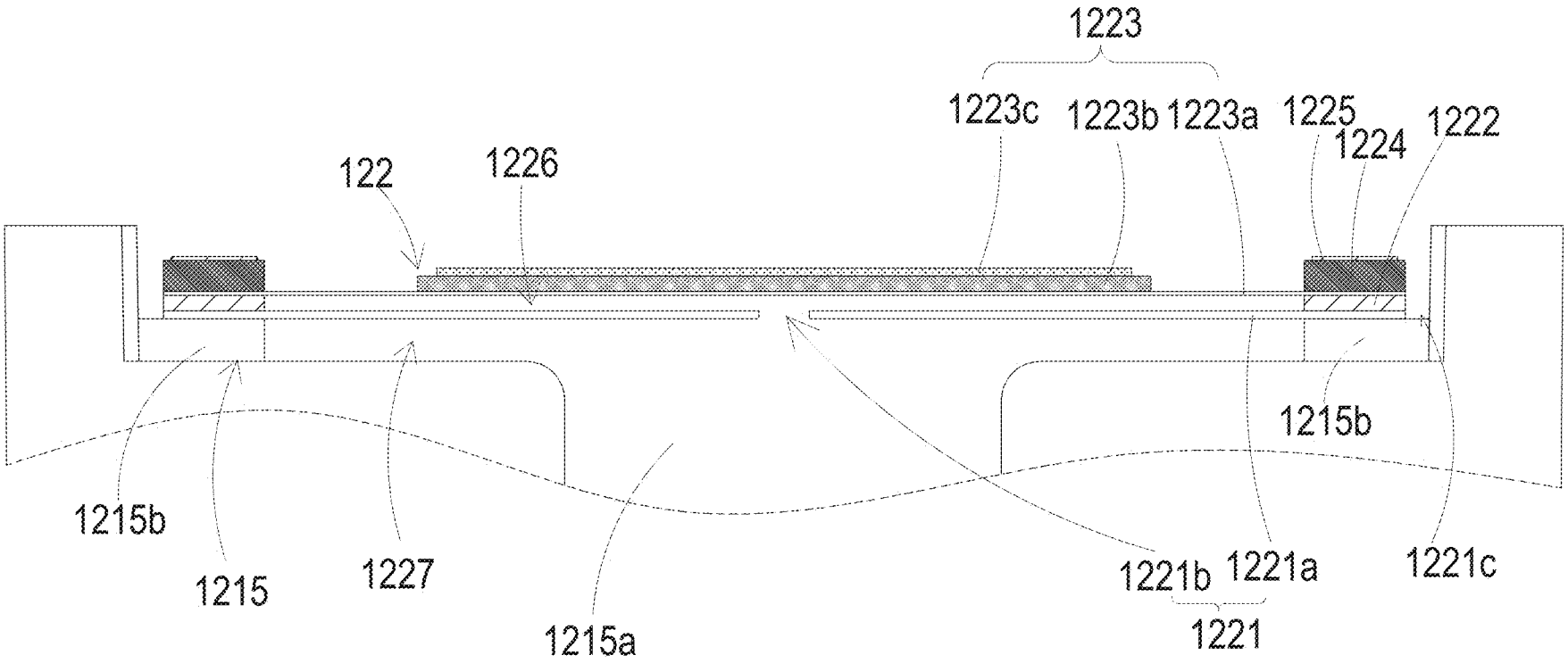
FIG. 9A is a schematic cross-sectional view (1) illustrating an action of the piezoelectric actuator according to the embodiment of the present disclosure.
Figure 9B:
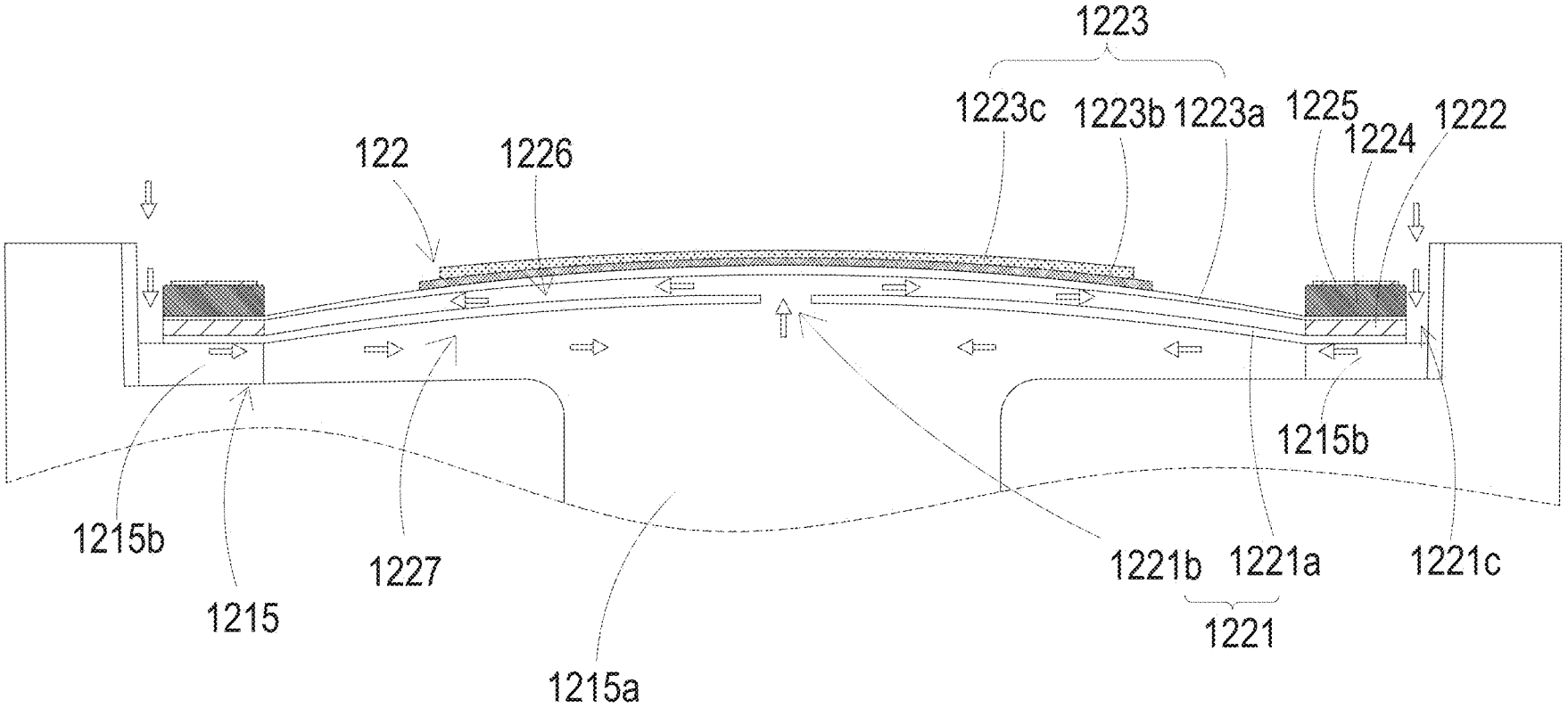
FIG. 9B is a schematic cross-sectional view (2) illustrating an action of the piezoelectric actuator according to the embodiment of the present disclosure.
Figure 9C:
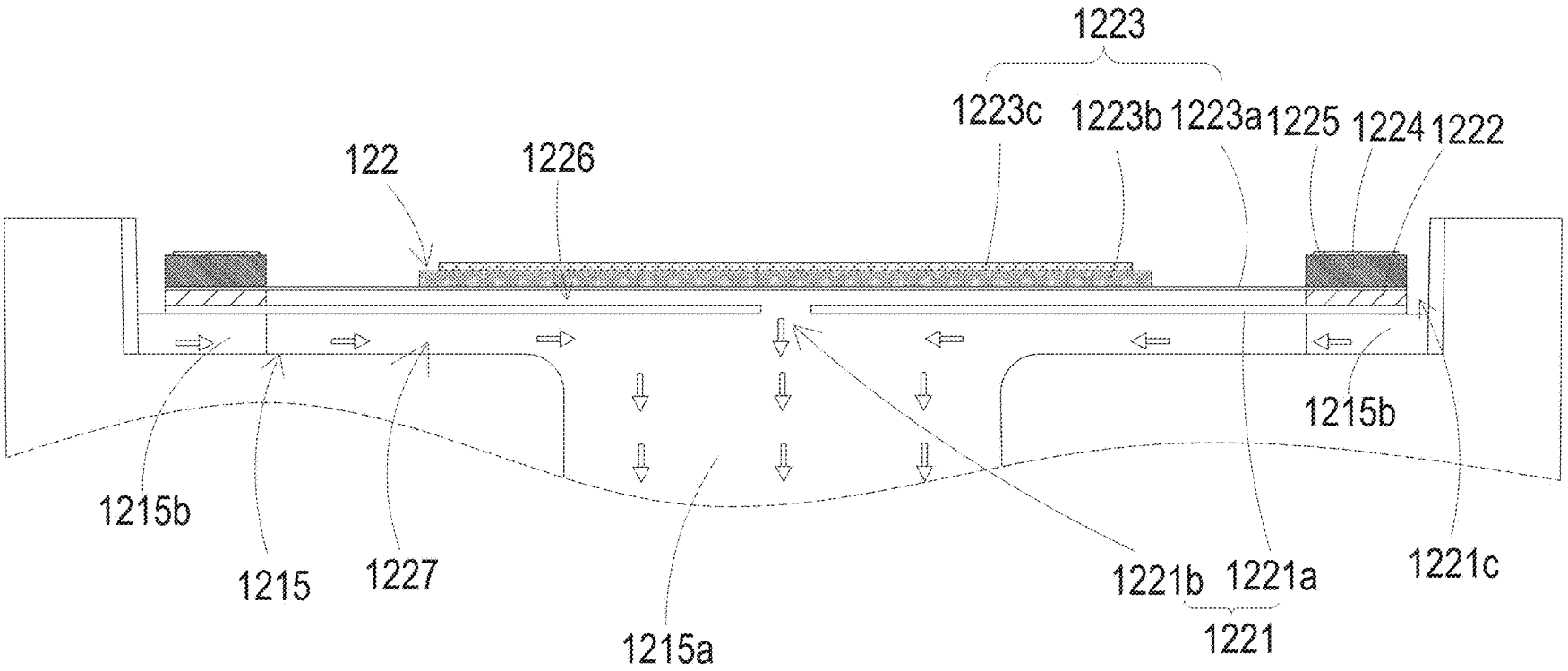
FIG. 9C is a schematic cross-sectional view (3) illustrating an action of the piezoelectric actuator according to the embodiment of the present disclosure.
Figure 10A:
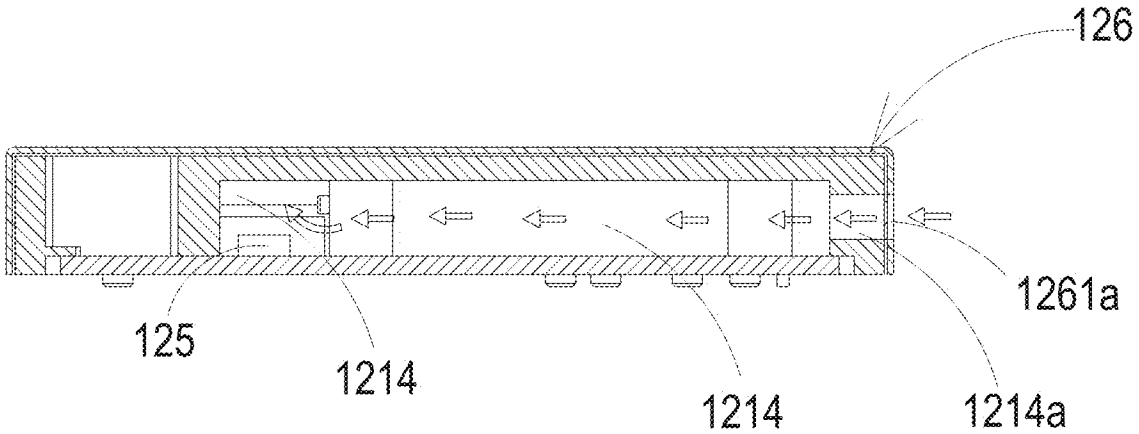
FIG. 10A is a schematic cross-sectional view (1) illustrating the gas detection main part according to the embodiment of the present disclosure.
Figure 10B:
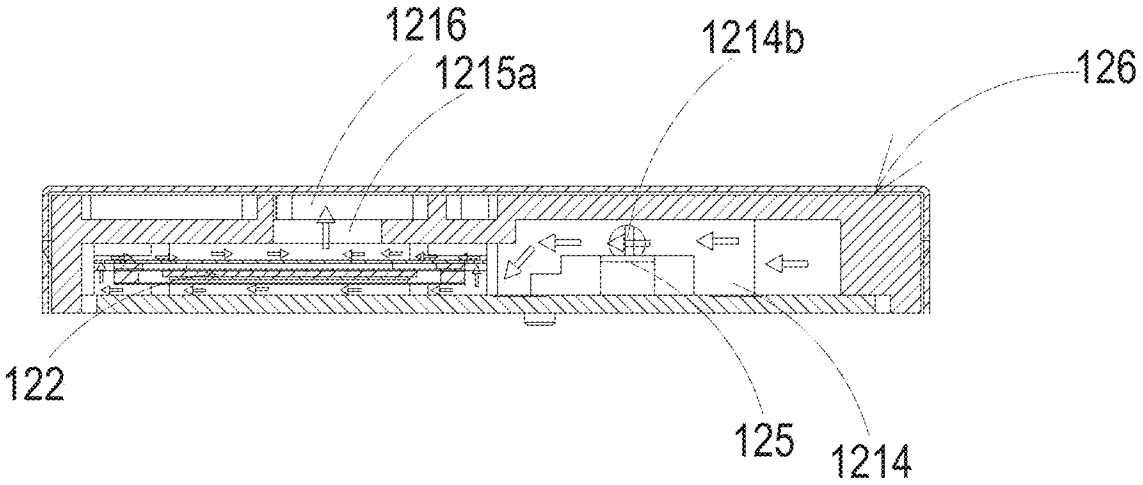
FIG. 10B is a schematic cross-sectional view (2) illustrating the gas detection main part according to the embodiment of the present disclosure.
Figure 10C:
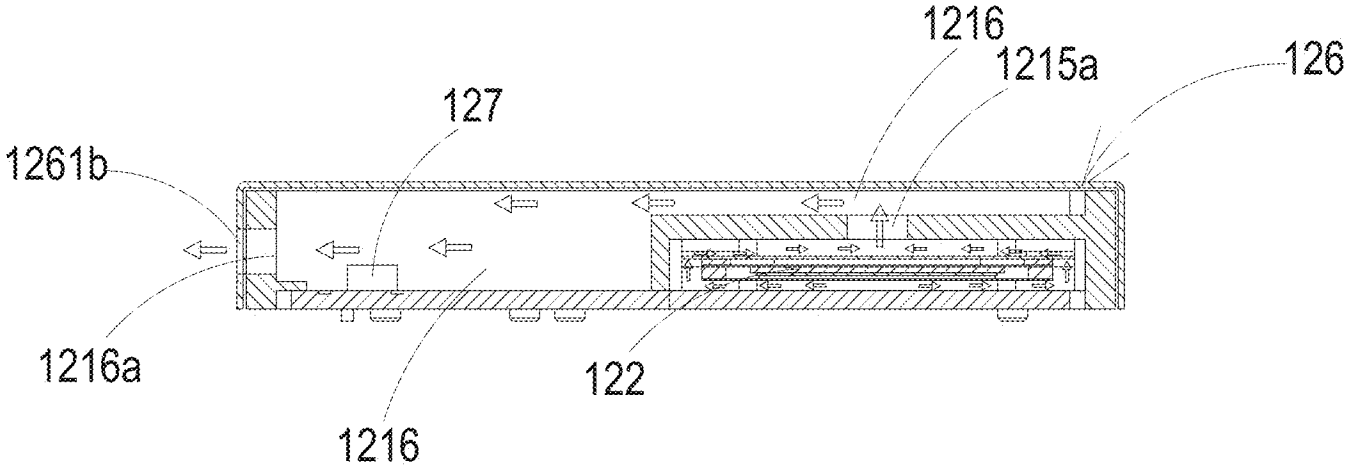
FIG. 10C is a schematic cross-sectional view (3) illustrating the gas detection main part according to the embodiment of the present disclosure.

By repeating the above operation steps shown in FIG. 9B and FIG. 9C, the piezoelectric plate 1223*c* is driven to generate the bending deformation in a reciprocating manner. According to the principle of inertia, since the gas pressure inside the resonance chamber 1226 is lower than the equilibrium gas pressure after the converged gas is ejected out, the gas is introduced into the resonance chamber 1226 again. Moreover, the vibration frequency of the gas in the resonance chamber 1226 is controlled to be close to the vibration frequency of the piezoelectric plate 1223*c*, so as to generate the Helmholtz resonance effect to achieve the gas transportation at high speed and in large quantities. The gas is inhaled through the gas-inlet 1214*a* on the outer cover 126, flows into the gas-inlet groove 1214 of the base 121 through the gas-inlet 1214*a*, and is transported to the position of the particulate sensor 125. The piezoelectric actuator 122 is enabled continuously to inhale the gas into the inlet path, and facilitate the gas outside the gas detection module to be introduced rapidly, flow stably, and transported above the particulate sensor 125. At this time, a projecting light beam emitted from the laser component 124 passes through the transparent window 1214*b* to irritate the suspended particles contained in the gas flowing above the particulate sensor 125 in the gas-inlet groove 1214. When the suspended particles contained in the gas are irradiated and generate scattered light spots, the scattered light spots are received and calculated by the particulate sensor 125 for obtaining related information about the sizes and the concentration of the suspended particles contained in the gas. Moreover, the gas above the particulate sensor 125 is continuously driven and transported by the piezoelectric actuator 122, flows into the ventilation hole 1215*a* of the gas-guiding-component loading region 1215, and is transported to the gas-outlet groove 1216. At last, after the gas flows into the gas outlet groove 1216, the gas is continuously transported into the gas-outlet groove 1216 by the piezoelectric actuator 122, and thus the gas in the gas-outlet groove 1216 is pushed to discharge through the gas-outlet 1216*a* and the outlet opening 1261*b*.

The gas detector 1 of the present disclosure not only can detect the particulate matters in the gas, but also can detect the gas characteristics of the introduced gas, for example, to determine whether the gas is formaldehyde, ammonia, carbon monoxide, carbon dioxide, oxygen, ozone, or the like. Therefore, in some embodiments, the gas detector 1 of the present disclosure further includes a gas sensor 127 positioned and disposed on the driving circuit board 123, electrically connected to the driving circuit board 123, and accommodated in the gas-outlet groove 1216, so as to detect the gas characteristics of the introduced gas. Preferably but not exclusively, in an embodiment, the gas sensor 127 includes a volatile-organic-compound sensor for detecting the information of carbon dioxide (CO2) or volatile organic compounds (TVOC). Preferably but not exclusively, in an embodiment, the gas sensor 127 includes a formaldehyde sensor for detecting the information of formaldehyde (HCHO) gas. Preferably but not exclusively, in an embodiment, the gas sensor 127 includes a bacteria sensor for detecting the information of bacteria or fungi. Preferably but not exclusively, in an embodiment, the gas sensor 127 includes a virus sensor for detecting the information of virus in the gas. Preferably but not exclusively, the gas sensor 127 is a temperature and humidity sensor for detecting the temperature and humidity information of the gas.

In summary, the present disclosure provides an air pollution prevention system for bathroom space for solving the problem that air pollution occurs anytime and moves randomly in the indoor field. By disposing a plurality of gas detectors in the outdoor and indoor fields, the gas detectors can determine the air pollution and output the air pollution information. Then, the cloud computing server receives and stores the air pollution information to form a database of air pollution data. When the value of air pollution information of the bathroom space exceeds the safety detection value, the cloud computing server issues a control command to enable the exhaust fan for exhausting the air pollution to the outdoor field, and simultaneously selects and issues another control command to the fan of the filtration device for rapidly guiding the air pollution to pass through the filter element for filtration and purification, thereby controlling the gas state of the bathroom space at a level of air pollution close to zero. Therefore, the present disclosure is extremely industrially applicable.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An air pollution prevention system for bathroom space, comprising:

a plurality of gas detectors disposed in an outdoor field for detecting air pollution and outputting outdoor air pollution information, and disposed in a bathroom space for detecting air pollution and outputting indoor air pollution information;

at least one filtration device disposed in the bathroom space for filtering the air pollution in the bathroom space;

at least one exhaust fan disposed in the bathroom space for guiding and exhausting the air pollution in the bathroom space to the outdoor field, and forming a gas exchanging of the bathroom space; and a cloud computing server receiving and storing the outdoor air pollution information of the outdoor field and the indoor air pollution information of the bathroom space to form a database of air pollution data, wherein when a value of the air pollution information exceeds a safety detection value, the cloud computing server intelligently selects and issues a control command for enabling the at least one exhaust fan to guide the air pollution to exhaust to the outdoor field and controlling the gas exchanging of the bathroom space to adjust a temperature and a humidity thereof, and simultaneously, performs an artificial intelligence computing for determining a location of the air pollution in the bathroom space and intelligently selects and issues another control command for enabling the at least one filtration device to rapidly guide the air pollution in the bathroom space to pass through the at least one filtration device for filtration and purification, thereby controlling a gas state of the bathroom space at a level of air pollution close to zero.

2. The air pollution prevention system for bathroom space according to claim 1, wherein the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus, and a combination thereof.

3. The air pollution prevention system for bathroom space according to claim 1, wherein the cloud computing server comprises a wireless network cloud computing service module, a cloud control service unit, a device management unit and an application program unit.

4. The air pollution prevention system for bathroom space according to claim 1, wherein the air pollution information comprises a value of at least one selecting from the group consisting of $CO_2$, VOC, PM2.5, temperature and humidity, and when the value of the air pollution information exceeds a safety detection value, the control command is issued to enable the at least one exhaust fan and the at least one filtration device in the bathroom space.

5. The air pollution prevention system for bathroom space according to claim 1, further comprising a gas detection module comprising a controlling circuit board, a gas detection main part, a microprocessor and a communicator, wherein the gas detection main part, the microprocessor and the communicator are integrally packaged on the controlling circuit board and electrically connected to each other, the microprocessor controls the gas detection main part to detect, the gas detection main part detects the air pollution and outputs air pollution information, and the microprocessor processes and provides the air pollution information to the communicator for external transmission.

6. The air pollution prevention system for bathroom space according to claim 5, wherein the gas detection main part comprises:

a base comprising:

a first surface;

a second surface opposite to the first surface;

a laser loading region hollowed out from the first surface to the second surface;

a gas-inlet groove concavely formed from the second surface and disposed adjacent to the laser loading region, wherein the gas-inlet groove comprises a gas-inlet and two lateral walls, and a transparent window is respectively opened on the two lateral walls and is in communication with the laser loading region;

a gas-guiding-component loading region concavely formed from the second surface and in communication with the gas-inlet groove, wherein a ventilation hole penetrates a bottom surface of the gas-guiding-component loading region; and a gas-outlet groove concavely formed from the first surface, spatially corresponding to the bottom surface of the gas-guiding-component loading region, and hollowed out from the first surface to the second surface in a region where the first surface is not aligned with the gas-guiding-component loading region, wherein the gas-outlet groove is in communication with the ventilation hole, and a gas-outlet is disposed in the gas-outlet groove;

a piezoelectric actuator accommodated in the gas-guiding-component loading region;

a driving circuit board covering and attached to the second surface of the base;

a laser component positioned and disposed on the driving circuit board, electrically connected to the driving circuit board, and accommodated in the laser loading region, wherein a light beam path emitted from the laser component passes through the transparent window and extends in a direction perpendicular to the gas-inlet groove, thereby forming an orthogonal direction with the gas-inlet groove;

a particulate sensor positioned and disposed on the driving circuit board, electrically connected to the driving circuit board, and disposed at an orthogonal position where the gas-inlet groove intersects the light beam path of the laser component in the orthogonal direction, so that suspended particles contained in the air pollution passing through the gas-inlet groove and irradiated by a projecting light beam emitted from the laser component are detected;

a gas sensor positioned and disposed on the driving circuit board, electrically connected to the driving circuit board, and accommodated in the gas-outlet groove, so as to detect the air pollution introduced into the gas-outlet groove; and an outer cover covering the base and comprising a side plate, wherein the side plate has an inlet opening and an outlet opening, the inlet opening is spatially corresponding to the gas-inlet of the base, and the outlet opening is spatially corresponding to the gas-outlet of the base;

wherein the outer cover covers the base, and the driving circuit board covers the second surface, thereby an inlet path is defined by the gas-inlet groove, and an outlet path is defined by the gas-outlet groove, so that the air pollution is inhaled from the environment outside the base by the piezoelectric actuator, transported into the inlet path defined by the gas-inlet groove through the inlet opening, and passes through the particulate sensor to detect the particle concentration of the suspended particles contained in the air pollution, and the air pollution transported through the piezoelectric actuator is transported out of the outlet path defined by the gas-outlet groove through the ventilation hole, passes through the gas sensor for detecting, and then pushed to discharge through the gas-outlet of the base and the outlet opening.

7. The air pollution prevention system for bathroom space according to claim 6, wherein the particulate sensor detects information of suspended particles.

8. The air pollution prevention system for bathroom space according to claim 6, wherein the gas sensor comprises a volatile-organic-compound sensor for detecting information of carbon dioxide ($CO_2$) or volatile organic compounds (TVOC).

9. The air pollution prevention system for bathroom space according to claim 6, wherein the gas sensor comprises one selected from the group consisting of a formaldehyde sensor, a bacteria sensor, a virus sensor, and a combination thereof, for respectively detecting information of formaldehyde, information of bacteria or fungi, and information of virus.

10. The air pollution prevention system for bathroom space according to claim 6, wherein the gas sensor comprises a temperature and humidity sensor for detecting temperature and humidity information of gas.

11. The air pollution prevention system for bathroom space according to claim 1, wherein each of the at least one filtration device comprises a fan and a filter element, and the fan is enabled to guide the air pollution in the bathroom space to pass through the filter element for filtration and purification.

12. The air pollution prevention system for bathroom space according to claim 11, wherein the filter element comprises a high efficiency particulate air (HEPA) filter screen which purifies the air pollution through physical blocking and absorption.

13. The air pollution prevention system for bathroom space according to claim 12, wherein the HEPA filter screen is combined with a decomposition layer through coating to sterilize in chemical means.

14. The air pollution prevention system for bathroom space according to claim 13, wherein the decomposition layer comprises at least one selected from the group consisting of an activated carbon, a cleansing factor containing chlorine dioxide, and a combination thereof.

15. The air pollution prevention system for bathroom space according to claim 13, wherein the decomposition layer comprises an herbal protective layer extracted from ginkgo and Japanese *Rhus chinensis*.

16. The air pollution prevention system for bathroom space according to claim 13, wherein the decomposition layer comprises at least one selected from the group consisting of a silver ion, a zeolite, and a combination thereof.

17. The air pollution prevention system for bathroom space according to claim 12, wherein the filter element is combined with a light irradiation element to sterilize in chemical means.

18. The air pollution prevention system for bathroom space according to claim 17, wherein the light irradiation element is at least one selected from the group consisting of a photo-catalyst unit comprising a photo catalyst and an ultraviolet lamp, a photo-plasma unit comprising a nanometer irradiation tube, and a combination thereof.

19. The air pollution prevention system for bathroom space according to claim 11, wherein the filter element is combined with a decomposition unit to sterilize in chemical means.

20. The air pollution prevention system for bathroom space according to claim 19, wherein the decomposition unit is at least one selected from the group consisting of a negative ion unit, a plasma ion unit, and a combination thereof.

* * * * *